US005767773A

United States Patent [19]

Fujiuchi et al.

[11] Patent Number: 5,767,773

[45] Date of Patent: Jun. 16, 1998

[54] THEFT PREVENTIVE APPARATUS AND RADIO WAVE RECEIVING SIGNALING DEVICE

[75] Inventors: Hiroyuki Fujiuchi; Akira Saito; Kenji Uchida; Masayuki Yao, all of Osaka; Mitsuhiko Nakajima, Nagano; Shigeyoshi Takatori; Yasuhiro Noma, both of Tokyo; Hisakazu Okumura, Gunma; Yukio Saito, Tomioka, all of Japan

[73] Assignee: Kubota Corporation, Osaka, Japan

[21] Appl. No.: 776,509

[22] PCT Filed: Jul. 28, 1995

[86] PCT No.: PCT/JP95/01514

§ 371 Date: Apr. 17, 1997

§ 102(e) Date: Apr. 17, 1997

[87] PCT Pub. No.: WO96/04622

PCT Pub. Date: Feb. 15, 1996

[30] Foreign Application Priority Data

| | | | |
|---|---|---|---|
| Jul. 29, 1994 | [JP] | Japan | 6-178579 |
| Aug. 4, 1994 | [JP] | Japan | 6-183455 |
| Aug. 4, 1994 | [JP] | Japan | 6-183456 |
| Aug. 4, 1994 | [JP] | Japan | 6-183457 |
| Aug. 4, 1994 | [JP] | Japan | 6-183458 |
| Aug. 5, 1994 | [JP] | Japan | 6-184316 |

[51] Int. Cl.[6] ..... G08B 13/14

[52] U.S. Cl. ..... 340/571; 340/572; 340/568; 70/57.1

[58] Field of Search ..... 340/571, 572, 340/568, 693; 70/57.1

[56] References Cited

U.S. PATENT DOCUMENTS

| | | | |
|---|---|---|---|
| 3,253,271 | 5/1966 | Trupiano et al. | 340/510 |
| 3,755,803 | 8/1973 | Cole et al. | 340/572 |
| 3,995,900 | 12/1976 | Humble et al. | 70/57.1 |
| 4,000,543 | 1/1977 | Paskert | 340/572 |
| 4,274,088 | 6/1981 | Pierson et al. | 340/568 |
| 4,987,754 | 1/1991 | Minasy et al. | 70/57.1 |

(List continued on next page.)

FOREIGN PATENT DOCUMENTS

| | | |
|---|---|---|
| 0 385 800 | 9/1990 | European Pat. Off. . |
| 52-82094 | 7/1977 | Japan . |

(List continued on next page.)

OTHER PUBLICATIONS

Patent Abstracts of Japan, vol. 15, No. 246 (E-1081), Jun. 24, 1991; JP-A-03 077219 (Omron Corp.), Apr. 2, 1991.

*Primary Examiner*—Jeffery Hofsass
*Assistant Examiner*—Sihong Huang
*Attorney, Agent, or Firm*—Townsend and Townsend and Crew LLP

[57] ABSTRACT

The present invention relates to a theft preventive apparatus to be attached to an object of theft prevention for detecting a preliminary stealing act by e.g. issuing alarm, and relates also to a radio wave receiving signaling device to be used with the apparatus.

Conventionally, there has been a problem of the alarm output means being rendered inoperative when a sudden shock is applied to the theft preventive apparatus for example.

According to the present invention, a circuit board (6) of alarm output means (AO) disposed inside a box (2) to be attached to the object of theft prevention is retained to one first side wall portion (2*a*) of a pair of opposed wall portions (2*a*), (2*c*) of the box, and the other side second wall portion (2*c*) retains a first-kind constituting element (FE) of the alarm output means (AO).

A power-supply contact member (CE) formed integrally with the first-kind constituting element (FE) is adapted to contact a first-kind contact (FC) having a contact face extending toward the second wall portion of the circuit board (6).

And, the power-supply contact member (CE) is comprised of a coil spring which can expand and contract in the approaching/departing direction of the pair of wall portions (2*a*), (2*c*) and which is disposed under a state contracted from its maximally expanded state. Then, the electric contact may be maintained against sudden shock.

28 Claims, 16 Drawing Sheets

U.S. PATENT DOCUMENTS

| | | | |
|---|---|---|---|
| 4,992,776 | 2/1991 | Crossfield | 340/572 |
| 5,191,314 | 3/1993 | Ackerman et al. | 340/571 |
| 5,610,587 | 3/1997 | Fujiuchi et al. | 340/572 |
| 5,656,998 | 8/1997 | Fujiuchi et al. | 340/571 |

FOREIGN PATENT DOCUMENTS

| | | |
|---|---|---|
| 55-89192 | 12/1980 | Japan . |
| 61-160583 | 10/1986 | Japan . |
| 62-285328 | 12/1987 | Japan . |
| 63-195493 | 12/1988 | Japan . |
| 2-260098 | 10/1990 | Japan . |
| 4-20192 | 2/1992 | Japan . |
| 4-211897 | 8/1992 | Japan . |
| 4-108286 | 9/1992 | Japan . |
| 1015700 | 1/1966 | United Kingdom . |
| 2137391 | 10/1984 | United Kingdom . |
| 2205426 | 12/1988 | United Kingdom . |
| 90/09648 | 8/1990 | WIPO . |
| 91/13416 | 9/1991 | WIPO . |
| 95/06924 | 3/1995 | WIPO . |

THEFT PREVENTIVE APPARATUS AND RADIO WAVE RECEIVING SIGNALING DEVICE

TECHNICAL FIELD

The present invention relates to a theft preventive apparatus and a radio wave receiving signaling device, and more particularly to a theft preventive apparatus including a box to be attached to an object of theft prevention, preliminary act detecting means provided in the box for detecting a preliminary theft act, alarm output means disposed inside the box for outputting alarm information based on detection information of the preliminary act detecting means, a first wall portion of a pair of opposed wall portions of the box supports a circuit board of the alarm output means and the other second wall portion supports a first-kind constituting element of the alarm output means, and a power-supply contact member integrally formed with the first-kind constituting element is constructed so as to contact a first-kind contact having a contact face extending toward the second wall side of the circuit board. The invention relates also to a radio wave receiving signaling device used with the theft preventive apparatus.

BACKGROUND ART

Such theft preventive apparatus is used, with the box housing therein the alarm output means being attached to an object of theft prevention. Then, when a preliminary stealing act is committed, i.e. when the box is unlawfully removed from the object of theft prevention, this is detected and the alarm output means outputs alarm information, thereby to notify the commitment of such preliminary stealing act, whereby theft may be prevented.

The alarm output means of the theft preventive apparatus of this type is comprised of the circuit board mounting various circuit components thereon, the first-kind constituting element, which is a mechanical component that cannot be directly mounted on the circuit board. And, these constituting components are supported respectively to the pair of wall portions constituting the box and are assembled with the pair of wall portions placed one on the other in opposition to each other. The various components inside the box are electrically connected with each other, with a power-supply contact member formed integral with the first-kind constituting element being placed in contact with the first-kind contact which is a contact formed on the circuit board.

Conventionally, for this electric connection, the power-supply contact member is formed of a metal plate and with the elastic function of this metal plate, the power-supply contact member is pressed against the first-kind contact having a contact face extending toward the second wall portion supporting the first-kind constituting element.

However, with the above conventional construction, if e.g. the box of the theft preventive apparatus is dropped thereby to apply a sudden shock to the box and a force is applied in the approaching/departing direction of the pair of wall portions of the box, the power-supply contact member and the first-kind contact are momentarily detached from each other, thereby to break the electric connection of the alarm output means. Then, the alarm output means cannot operate normally.

For avoiding such inconvenience, the electric connection may be reliably effected by means of e.g. welding. In this case, however, the assembly operation of the box of the theft preventive apparatus becomes complicated, whereby the manufacturing costs may increase.

The present invention has been made in consideration to the above-described state of the art. Its object is to provide a theft preventive apparatus which can maintain the electric connection against sudden shock while facilitating the assembly operation of the box of the theft preventive apparatus.

A further object is to inhibit the alarm output means from being readily rendered into the inoperative state unlawfully by e.g. a fake operating tool other than the authorized releasing tool.

A still further object is to provide a theft preventive apparatus which is easy to handle and practical such as being resistant against erroneous operation of the alarm output means or providing increased volume of the buzzer sound. A still further object is to provide a radio wave receiving signaling device to be used with the theft preventive apparatus described above.

DISCLOSURE OF THE INVENTION

For accomplishing the objects as above, according to the characterizing features of a theft preventive apparatus relating to the present invention, the theft preventive apparatus includes a box to be attached to an object of theft prevention, preliminary act detecting means provided in the box for detecting a preliminary theft act, alarm output means disposed inside the box for outputting alarm information based on detection information of the preliminary act detecting means, a first wall portion of a pair of opposed wall portions of the box supports a circuit board of the alarm output means and the other second wall portion supports a first-kind constituting element of the alarm output means, and a power-supply contact member integrally formed with the first-kind constituting element is constructed so as to contact a first-kind contact having a contact face extending toward the second wall side of the circuit board;

wherein the power-supply contact member is comprised of a coil spring which can expand and contract in the approaching/departing direction of the pair of wall portions and which is disposed with being compressed from a maximally expanded state thereof; and a radio-wave receiving antenna having a coil is provided;

the alarm output means is rendered operative when the receiving antenna receives a sound generation instructing radio wave;

inside the box, there is provided a radio-wave receiving signaling device forming a resonance circuit by connecting the alarm output means with the entire or part of the coil of the receiving antenna; and a transmitter for transmitting the sound generation instructing radio wave to the receiving antenna is installed at a predetermined site.

With this construction, the power-supply contact member comprised of a coil spring which can expand and contract in the approaching/departing direction of the pair of wall portions and which is disposed with being compressed from a maximally expanded state thereof comes into contact with the first-kind contact of the circuit board, thereby to electrically connect the first-kind constituting element constituting the alarm output means and the circuit board.

Accordingly, when a sudden shock is applied to the box of the theft preventive apparatus thus applying a force in the approaching/departing direction of the pair of wall portions of the box, the coil spring as the power-supply contact member can appropriately absorb this force, thereby to maintain the electric contact between the first-kind constituting element and the circuit board.

Further, when the box of the theft preventive apparatus is to be assembled, this assembly may be done with a simple operation of overlapping the first wall portion supporting the circuit board and the second wall portion supporting the first-kind constituting element in opposition to each other while compressing the coil spring as the power-supply contact member.

As a result, while the assembly operation of the box of the theft preventive apparatus is facilitated, the electric connection may be maintained against a sudden shock.

According to a further construction of the present invention, between the pair of wall portions, a second-kind constituting element of the alarm output means is retained as being bound therebetween; a power-supply relay member having one end contacting with a second-kind contact having a contact face extending toward the second wall portion side of the circuit board and the other end contacting with the second-kind constituting element is disposed with an intermediate portion thereof retained to the first wall portion; and a pressing coil spring which can expand and contract in the approaching/departing direction of the pair of wall portions and which presses one end of the power-supply relay member is disposed with being compressed from a maximally expanded state thereof.

With this construction, the second-kind constituting element constituting the alarm output means together with the circuit board and the first-kind constituting element is retained with being bound between the pair of wall portions and electrically connected with the circuit board via the power-supply relay member. The power-supply relay member has its intermediate portion retained to the first wall portion retaining the circuit board, its one end contacting with the second-kind contact having the contact face extending toward the second wall portion side of the circuit board and its other end contacting with the second-kind constituting element.

At the contact portion between the power-supply relay member and the to circuit board, the pressing coil spring which can expand and contract in the approaching/departing direction of the pair of wall portions of the box presses the power-supply relay member against the second-kind contact.

Accordingly, when a sudden shock is applied to the box of the theft preventive apparatus thus applying a force in the approaching/departing direction of the pair of wall portions of the box, the pressing coil spring can appropriately absorb this force, thereby to maintain the electric contact between the second-kind constituting element and the circuit board.

Further, when the box of the theft preventive apparatus is to be assembled, this assembly may be done with a simple operation of overlapping the first wall portion supporting the circuit board and the second wall portion supporting the first-kind constituting element in opposition to each other and binding the second-kind constituting element therebetween while compressing the pressing coil spring.

As a result, in spite of the second-kind constituting element as a constituting component of the alarm output means, while the assembly operation of the box of the theft preventive apparatus is facilitated, the electric connection may be maintained against a sudden shock.

Still further, the box according to the present invention may include a first casing member having a cylindrical wall portion projecting from the first wall portion and projecting also from the periphery of the first wall portion toward the second wall portion and a second casing member having a cylindrical wall portion projecting from the second wall portion and projecting also from the periphery of the second wall portion toward the first wall portion, with end faces of the first and second casing members being fused to each other.

With this construction, by fusing the first casing member having the first wall portion and the second casing member having the second wall portion, the first wall portion and the second portion may be reliably assembled in opposition to each other. Further, by means of the cylindrical wall portions of the two casing members, the components of the alarm output means supported to the first and second wall portions may be protected.

As a result, the box may be assembled reliably while protecting the components of the alarm output means housed inside the box of the theft preventive apparatus.

Still preferably, the first-kind constituting element of the present invention is a disc-shaped alarm buzzer; the second-kind constituting element is a disc-shaped battery; and this disc-shaped battery is retained with being bound between the alarm buzzer and the first wall portion.

With this construction, the disc-shaped battery as the second-kind constituting element is retained with being bound between the disc-shaped alarm buzzer as the first-kind constituting element supported to the second wall portion and the first wall portion.

That is to say, the battery and the alarm buzzer having similar shapes originally are disposed one on the other.

As a result, as the battery and the alarm buzzer having similar shapes originally are disposed one on the other, the box of the theft preventive apparatus may be formed compact.

According to still further construction of the present invention, the preliminary act detecting means includes an attachment tool to be connected ith the box for attaching the box to the object of theft prevention and an attachment/detachment detecting switch for electrically detecting attachment and detachment of this attachment tool to and from the box; and the alarm output means outputs the alarm information based on a detachment detection signal from the attachment/detachment detecting switch.

With this construction, when there has been committed a preliminary stealing act of detaching the box of the theft preventive apparatus attached to the object of theft prevention via the attachment tool by unlawfully detaching the attachment tool from the box, the attachment/detachment detecting switch detects the detachment of the attachment tool, whereby the alarm output means outputs alarm information.

As a result, a preliminary stealing act of unlawfully detaching the box of the theft preventive apparatus from the object of theft prevention may be detected and signaled reliably.

According to still further construction of the present invention, the preliminary act detecting means includes an antenna disposed inside the box for receiving a radio wave transmitted from a transmitter installed at a predetermined site; and the alarm output means outputs the alarm information based on a reception signal from the antenna.

With this construction, if there has been committed a preliminary stealing act as unlawfully taking out the object of theft prevention with the theft preventing apparatus being attached thereto from a site of display for example, when this is carried past the predetermined site where the transmitter is installed, the radio wave transmitted from the transmitter is received by the antenna disposed inside the box, so that the alarm output means outputs the alarm information based on the reception signal from the antenna.

As a result, it becomes possible to prevent such unlawful act as unlawful take-out of the object of theft prevention with the theft preventive apparatus being attached thereto.

Still further, according to the present invention, the releasing tool may be formed in a predetermined shape, and inside the insertion hole, there may be provided insertion preventing means for preventing insertion into the insertion hole of a fake operating tool having a shape other than the predetermined shape while allowing insertion into the insertion hole of the releasing tool having this predetermined shape.

With this construction, if an attempt is made to insert a fake operating tool having a shape other than the predetermined shape into the insertion hole defined in the box of the theft preventive apparatus,the insertion preventing means provided inside the insertion hole prevents the insertion of this fake operating tool, giving no effect on the operation of the alarm releasing means.

On the other hand, when the releasing tool is inserted into the insertion hole, the insertion preventing means allows the insertion of the releasing tool, and the alarm releasing means is operated into the alarm releasing state to render the alarm output means inoperative.

As a result, if an attempt is made to insert a fake operating tool having a shape other than the predetermined shape into the insertion hole defined in the box of the theft preventive apparatus, the insertion preventing means provided inside the insertion hole prevents the insertion of this fake operating tool. Then, it is possible to quickly prevent the alarm preventive apparatus from being unlawfully rendered inoperative.

Still further, the insertion preventing means may be comprised of a projection which projects from an inner wall portion of the insertion hole into the inner space thereof as viewed in a longitudinal direction of the insertion hole, and the releasing tool may define, in an outer face portion thereof, a concave groove into which the projection fits when the tool is inserted into the insertion hole.

With this construction, because of the projection projecting from the inner wall portion of the insertion hole into the inner space of the hole, if an attempt is made to insert into the insertion hole any fake operating tool having a shape other than the predetermined shape, the insertion is prevented by the projection, giving no effect on the operation of the alarm releasing means.

On the other hand, in the case of inserting the releasing tool into the insertion hole, since the releasing tool defines in the outer face thereof the concave groove in which the projection can fit, the projection fits into the concave groove thereby to allow the releasing tool to be inserted into the insertion hole. Then, the alarm releasing means is operated into the alarm releasing state to render the alarm output means inoperative.

That is to say, by simply providing the projection in the inner wall of the insertion hole and forming, in the outer face of the releasing tool, the concave groove in which the projection can fit, insertion of a fake operating tool into the insertion hole may be prevented.

As a result, by the simple construction of providing the projection in the inner wall of the insertion hole and forming, in the outer face of the releasing tool, the concave groove in which the projection can fit, the effect by the first characterizing feature described hereinbefore can be achieved.

Still alternatively, the projection may be formed at a further inside portion than the entrance opening of the insertion hole.

With this construction, since the projection is formed at a further inside portion than the entrance opening of the insertion hole, it is not easy to observe the shape of the projection from the entrance opening of the insertion hole, thus making it difficult to fabricate unlawfully a copy of the releasing tool.

As a result, since it becomes possible to make it difficult to fabricate unlawfully a copy of the releasing tool, it is possible to prevent more effectively the theft preventive apparatus from being rendered inoperative unlawfully.

Still alternatively, a plurality of the projections may be formed at different phases as viewed in the longitudinal direction of the insertion hole.

With this construction, the projections at the insertion hole are provided in a plurality and these projections are formed at different phases as viewed in the longitudinal direction of the insertion hole, that is, they are formed at different phases relative to a virtual circle, provided various positions along the inner wall of the insertion hole as viewed in the longitudinal direction thereof are expressed with reference to the virtual circle centering about the center of the insertion hole as viewed in the longitudinal direction of the insertion hole. Then, this prevents one projection from being concealed by another projection when viewed in the longitudinal direction of the insertion hole. Then, each of the plurality of projections can serve to effectively prevent insertion of a fake operating tool.

As a result, since each of the plurality of projections formed at the insertion hole of the box of the theft preventive apparatus can serve to effectively prevent insertion of a fake operating tool, it is possible to more effectively prevent the theft preventive apparatus from being rendered inoperative unlawfully.

Still alternatively, the plurality of projections may be formed at different longitudinal positions of the insertion hole.

With this construction, since the plurality of projections are formed at different longitudinal positions, there are formed differences in the lengths of the concave grooves formed in the outer face of the releasing tool for allowing engagement of the plurality of projections. As a result, there exist also thick portions and thin portions in the thickness of the releasing tool.

As a result, since thick portions and thin portions exist in the thickness of the releasing tool, then, in comparison with a case in which the plurality of projections are aligned at a same longitudinal position and the thickness of the releasing tool becomes uniformly thin because of forming the concave grooves for allowing engagement of these projections, the strength of the releasing tool may be increased.

Still alternatively, the projection may be provided in the form of a projecting ridge extending along the longitudinal direction of the insertion hole.

With this construction, since the projection of the insertion hole is provided in the form of a projecting ridge extending along the longitudinal direction of the insertion hole, this makes the length of engagement of the projection of the insertion hole into the concave groove of the releasing tool when the releasing tool is inserted into the insertion hole. Whereby the projection can maintain the posture of the releasing tool stably.

As a result, since the posture of the releasing tool may be maintained stably by the projection formed at the insertion hole of the box of the theft preventive apparatus, the releasing tool may be readily inserted into the insertion hole, and the theft preventive apparatus becomes easier to handle.

According to still further construction of the theft preventive apparatus of the present invention, inside the box, there are provided a battery for driving the preliminary act detecting means and the alarm output means; and auxiliary power supplying means charged by the battery and driving the preliminary act detecting means and the alarm output means when power supply from the battery is cut off.

The auxiliary power supplying means stores electric power by being charged by the battery. Then, the power supply to the preliminary act detecting means and the alarm output means from the battery should be cut off by the positive or negative terminal of the battery is instantaneously detached from the connecting terminals with application of physical impact or vibration to the box, the auxiliary power supplying means, instead of the battery, continuously supplies electric power to the preliminary act detecting means and the alarm output means. Hence, the power supply to the preliminary act detecting means and the alarm output means is not interrupted.

With this construction, even if physical impact or vibration is applied to the box, the electric power may be continuously supplied to the preliminary act detecting means and the alarm output means, thus preventing the alarm output means from becoming inoperative.

Still alternatively, the alarm output means may continuously output the alarm information even if the preliminary act detecting means makes no detection of preliminary stealing act, after the alarm output means has outputted the alarm information based on preliminary stealing act detection information of the preliminary act detecting means.

With output of the alarm information, even if the one who has committed the preliminary stealing act renders the preliminary act detecting means inoperative for detecting a preliminary stealing act, the alarm information is continuously outputted from the alarm output means. Needless to say, since the auxiliary power supplying means is provided, the alarm information will be outputted continuously even if the power supply from the battery is cut off momentarily.

As a result, even if the one who has committed the preliminary stealing act disables detection of preliminary stealing act or if the power supply from the battery is cut off instantaneously, the alarm information is continuously outputted. Hence, the reliability has been further improved.

Still alternatively, the preliminary act detecting means may include an attachment tool to be connected with the box for attaching the box to the object of theft prevention, and an attachment/detachment detecting switch for electrically detecting attachment and detachment of the attachment tool to and from the box, and the alarm output means may output the alarm information based on an attachment/detachment signal from the attachment/detachment detecting switch as the preliminary act detection information.

If a preliminary stealing act is committed of detaching the attachment tool from the box in order to unlawfully detach the box from the object of theft prevention, the attachment/detachment detecting switch electrically detects this detachment of the attachment tool from the box. That is, based on the detection by the attachment/detachment detecting switch of detachment of the attachment tool from the box, the preliminary stealing act information is detected. And, based on the detachment detection information from the attachment/detachment detecting switch, the alarm means outputs the alarm information.

As a result, since the alarm information is outputted when a preliminary stealing act has been committed of unlawfully detaching the box of the theft preventive apparatus from the object of theft prevention, theft may be prevented.

Still alternatively, the preliminary act detecting means may include an antenna disposed inside the box for receiving radio wave from a transmitter installed at a predetermined site, and the alarm output means may output the alarm information based on a reception signal of the antenna as the preliminary stealing act detection information.

When a preliminary stealing act has been committed of the object of theft prevention with the box attached thereto being unlawfully taken out from the shop, the box comes near the transmitter installed at a predetermined site such as an exit of the shop. With the box approaching the transmitter, radio wave transmitted from the transmitter is received by the antenna disposed inside the box. That is to say, based on the antenna receiving the radio wave from the transmitter, the preliminary stealing act information may be detected. And, based on the reception signal of the antenna, the alarm means outputs the alarm information.

As a result, since the alarm information is outputted if a preliminary stealing act has been committed of the object of theft prevention with the box of the theft preventive apparatus attached thereto being unlawfully taken out of the shop, theft may be prevented.

Still further, the theft preventive apparatus of the present invention may further comprise checking means for allowing the alarm output means to output the alarm information only when the preliminary stealing act detection information outputted from the preliminary act detecting means continues to exist beyond a predetermined time period.

With this construction, when the preliminary stealing act detection information outputted from the preliminary act detecting means continues to exist beyond a predetermined time period, the alarm output means outputs the alarm information. Yet, in case the preliminary stealing act detection information continues shorter than the predetermined period of time when, for example, the preliminary act detecting means makes output due to various disturbances, the alarm information is not outputted.

As a result, it is possible to prevent a false alarm from being given when no preliminary stealing act has been actually committed due to various disturbances or the like. Then, the operational reliability of the theft preventive apparatus may be improved.

Still further, the preliminary act detecting means may include an attachment tool to be connected to the box for attaching the box to the object of theft prevention and an attachment/detachment detecting switch for electrically detecting attachment and detachment of the attachment tool to and from box, and the alarm output means may output the alarm information based on a detachment detection signal from the attachment/detachment detecting switch as the preliminary stealing act detection information.

With this construction, when the attachment tool such as a wire connected with the box for attaching the box to the object of theft prevention is detached from the box by being disconnected or cut off from the connecting portions, the attachment/detachment detecting switch detects this detachment of the attachment tool from the box as a preliminary stealing act. And, if this detachment detection signal continues beyond the predetermined time period, the alarm output means outputs the alarm information. Whereas, if the detachment detection signal continues shorter than the predetermined time period when, for example, the contact of the attachment/detachment detecting switch is disconnected for a short period of time due to e.g. application of slight shock or vibration to the box, no alarm information is outputted.

As a result, in the theft preventive apparatus with which the box is attached to the object of theft prevention by means of an attachment tool such as a wire and a preliminary stealing act is detected as detachment of the attachment tool from the box, no erroneous alarm as a preliminary stealing act is given due to the disturbances.

Still alternatively, the preliminary act detecting means includes an antenna disposed inside the box for receiving radio wave from a transmitter installed at a predetermined site, and the alarm output means outputs the alarm information as preliminary stealing act detection information, based on a reception signal of the antenna.

With this construction, when the antenna disposed inside the box receives radio wave from the transmitter installed at the predetermined site such as an entrance/exit, this reception signal is detected as preliminary stealing act detection information. And, if this reception signal continues longer than the predetermined period of time, the alarm output means outputs the alarm information. Whereas, if the reception signal continues shorter than the predetermined period of time when, for example, the antenna receives a noise for a short period of time, the alarm information is not outputted.

As a result, in the case of the theft preventive apparatus adapted for detecting a preliminary stealing act such as an attempt to take out the object of theft prevention together with the theft preventive apparatus attached thereto by means of an antenna housed within a box and receiving radio wave from a transmitter installed at an entrance/exit or the like, it becomes possible to prevent a false alarm on a preliminary stealing act from being erroneously issued due to e.g. noise.

According to still further construction of the present invention, the apparatus further comprises an attachment tool having, at opposed ends thereof conductive connecting portions to be connected by being inserted into the insertion hole of the box for connection with the attachment tool and having also a conductive intermediate connecting portion for electrically interconnecting the connecting portions at the opposed ends. Engaged portions are provided at the opposed connecting portions. And, inside the box, there are provided engaging embers which can engage with the engaged portions at the connecting portions inserted into the insertion hole for connection with the attachment tool and which are urged toward the engaging side; and alarm output means electrically connected with the opposed connecting portions when the opposed connecting portions are connected with the box and outputting the alarm information based on a conductive path formed by the electrical connection becoming non-conductive. And, withdrawal of the connecting portions inserted into the insertion hole is prevented by means of engagement between the engaged portions and the engaging members.

Still alternatively, inside the box, there may be provided a conductive spring which is contacted with and pressed against an end of the connecting portions inserted into the insertion hole for connection of the attachment tool, with the spring being connected by means of a receiving member electrically connected with the alarm output means.

With this construction, there is provided the conductive spring which is retracted further inside in the longitudinal direction of the insertion hole with the pressed contact with the inserting end of the connecting portion. So that, via the spring and the inserting end of the connecting portion which are contacted with each other due to the pressed contact along the inserting direction of the connecting portion, the connecting portions and the alarm output means are electrically connected with each other. Then, even if the inserted connecting portion is moved along the inserting direction relative to the box, there hardly occurs sliding movement at the contact portion between the inserting end of the connecting portion and the spring. Thus, the contact condition between the spring and the inserting end of the connecting portion is stable.

As a result, since the contact condition between the spring and the inserting end of the connecting portion is stable, the alarm output means will hardly be operated erroneously.

Still preferably, the spring comprise a coil spring.

With this, a large elastic displacement amount can be set while fitting the spring along the insertion hole in a compact manner. Even when the inserted connecting portion tends to move along the inserting direction relative to the box, it is easy to maintain the contact between the spring and the inserting end of the connecting portion for an extended period of time.

As a result, since it is easy to maintain the contact between the spring and the inserting end of the connecting portion for an extended period of time even when the inserted connecting portion tends to move along the inserting direction relative to the box, it is possible to prevent erroneous activation of the alarm output means still more reliably.

Still further, inside the box, there are provided alarm releasing means for rendering the alarm output means inoperative and engagement releasing means for operating the engaging member into an engagement-released state. An insertion hole for releasing operation is defined to extend from the outer face of the box toward the inside of the box. The alarm releasing means is operated into the alarm releasing state and the engagement releasing means is operated into an engagement releasing state by means of a releasing tool to be inserted into the insertion hole for releasing operation.

With the above construction, by inserting the releasing tool into the insertion hole for releasing operation, the alarm releasing means is operated into the alarm releasing state and also the engagement releasing means is operated into the engagement releasing state. Thus, lawful detachment of the theft preventive apparatus from the object of theft prevention may be effected easily.

As a result, since the lawful detachment of the theft preventive apparatus from the object of theft prevention can be effected easily, it is possible to facilitate the handling of the theft preventive apparatus having alarm output means highly resistant against erroneous activation.

Still further, the spring may be provided with an urging force which moves the connecting portion to the outside of the box in association with an operation of the engaging member toward the engagement releasing side.

With this construction, when the engagement between the engaged portion and the engaging member is released, the connecting portion inserted into the insertion hole is pushed to the outside of the box by means of the urging force of the spring. Hence, the connecting portion may be readily withdrawn from the insertion hole.

As a result, since the withdrawal of the connecting portion from the insertion hole is facilitated, it is possible to facilitate the handling of the theft preventive apparatus having alarm output means highly resistant against erroneous activation.

Still further, inside the box, there may be provided an antenna for receiving radio wave from a transmitter installed at a predetermined site, and the alarm output means may output the alarm information, based on a reception signal of the antenna.

With this construction, when an attempt is made to unlawfully take out the object of theft prevention with the theft preventive apparatus attached thereto, the alarm output means disposed inside the box outputs the alarm information, thereby alarming the unlawful take-out of the object of theft prevention. And, there is no need of separately providing alarm output means for this purpose.

As a result, since it is possible to alarm an unlawful take-out of the object of theft prevention with the theft preventive apparatus attached thereto without providing separate alarm output means, it is possible to simplify the construction of the theft preventive apparatus having alarm output means highly resistant against erroneous activation.

According to still further construction of the present invention, there is provided a buzzer having electric capacity; the alarm output means causes the buzzer to generate a sound when the receiving antenna receives a sound generation instructing radio wave; and radio-wave receiving signaling device disposed in the box forms a resonance circuit by connecting the buzzer with the entire or part of the coil of the receiving antenna.

With this construction, by providing the radio wave receiving signaling device having the above-described characterizing construction inside the box, the sound volume of the buzzer may be increased and also it is possible to inhibit the circuit construction from becoming complicated.

As a result, since it is possible to increase the sound volume of the buzzer and also to inhibit the circuit construction from becoming complicated, the reception of the sound generation instructing radio wave from the transmitter may be reliably signaled by increasing the sound volume of the buzzer while inhibiting the construction of the theft preventive apparatus from becoming complicated and the box from being enlarged.

Still further, the alarm output means according to the present invention may be constructed so as to cause the buzzer to generate a sound in association with detection of preliminary act by the preliminary act detecting means.

With this construction, the buzzer is activated to generate the sound also when the preliminary act detecting means detects detachment of the box of the theft preventive apparatus from the object of theft prevention.

As a result, although theft cannot be prevented merely by activating the buzzer for generating a sound with reception of the sound generation instructing radio wave from the transmitter, if e.g. the box of the theft preventive apparatus is detached from the object of theft prevention and then this object is taken out past the site where the transmitter is installed. However, since detachment of the box of the theft preventive apparatus also is detected and signaled by the buzzer, theft can be effectively prevented.

According to still further construction of the theft preventive apparatus of the present invention, inside the box, there is provided alarm releasing means for rendering the alarm output means inoperative; an insertion hole for releasing operation is defined to extend from the outer face of the box to the inside of the box; and the alarm releasing means is operated into a sound generation released state by means of a releasing tool to be inserted into the insertion hole for releasing operation.

When the object of theft prevention is lawfully purchased for instance, it is necessary to prevent the buzzer from generating a sound when the box of the theft preventive apparatus is detached from the object of theft prevention. Then, with the above construction, by inserting the releasing too into the insertion hole defined in the box of the theft preventive apparatus, the alarm output means of the radio wave receiving signaling device is operated into the sound generation released state.

As a result, by the simple operation of merely inserting the releasing tool into the insertion hole defined in the box of the theft preventive apparatus, the alarm output means of the radio wave receiving signaling device may be operated into the sound generation released state. Also, the alarm output means of the radio wave receiving signaling device cannot be operated into the sound generation released state without the releasing tool. Hence, unlawful releasing operation may be prevented.

According to a radio wave receiving signaling device for use with the theft preventive apparatus according to the present invention, the device comprises a radio wave receiving antenna having a coil, an electrically capacitive buzzer, and alarm output means for activating the buzzer to generate sound when the receiving antenna receives a sound generation instructing signal. And, the buzzer and the entire or part of the coil of the receiving antenna are connected to form a resonance circuit.

With this construction, as the electrically capacitive buzzer and the entire or part of the coil of the receiving antenna are connected to form a resonance circuit, it is possible to raise the voltage to be applied to the buzzer by means of the resonance function of the electrically capacitive buzzer and the electrically inductive coil. As a result, the volume of the sound generated by the buzzer is increased.

As the coil originally provided for receiving the sound generation instructing radio wave is used also in the circuit construction for increasing the sound volume of the buzzer, it is possible to prevent the construction of the circuit for increasing the sound volume of the buzzer from becoming complicated.

With the above-described construction of the radio wave receiving signaling device, it is possible to increase the sound volume of the buzzer while restricting complexity of the circuit construction.

BEST MODES OF EMBODYING THE INVENTION

Next, embodiments of a theft preventing apparatus of the present invention will be described with reference to the accompanying drawings.

Figure 1:
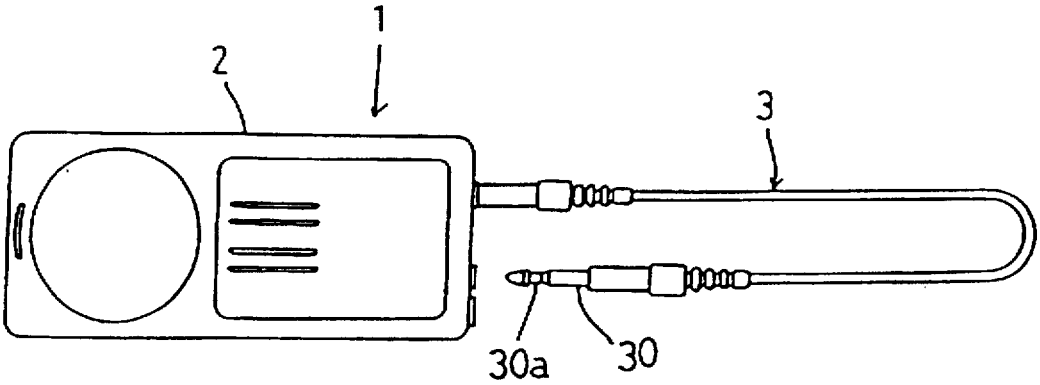
FIGS. 1(*a*), (*b*) are views showing outer appearances of a sensor tag relating to an embodiment of the present invention.
Figure 1:
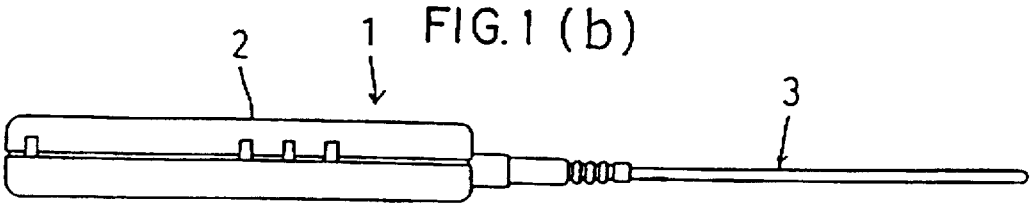

As shown in a plan view of FIG. 1 (*a*) and a side view of FIG. 1 (*b*), a sensor tag 1 as a theft preventive apparatus includes a rectangular box 2 and a wire unit 3 having a function as an attachment tool for attaching the box 2 to a commodity as an object of theft prevention.

Figure 6:
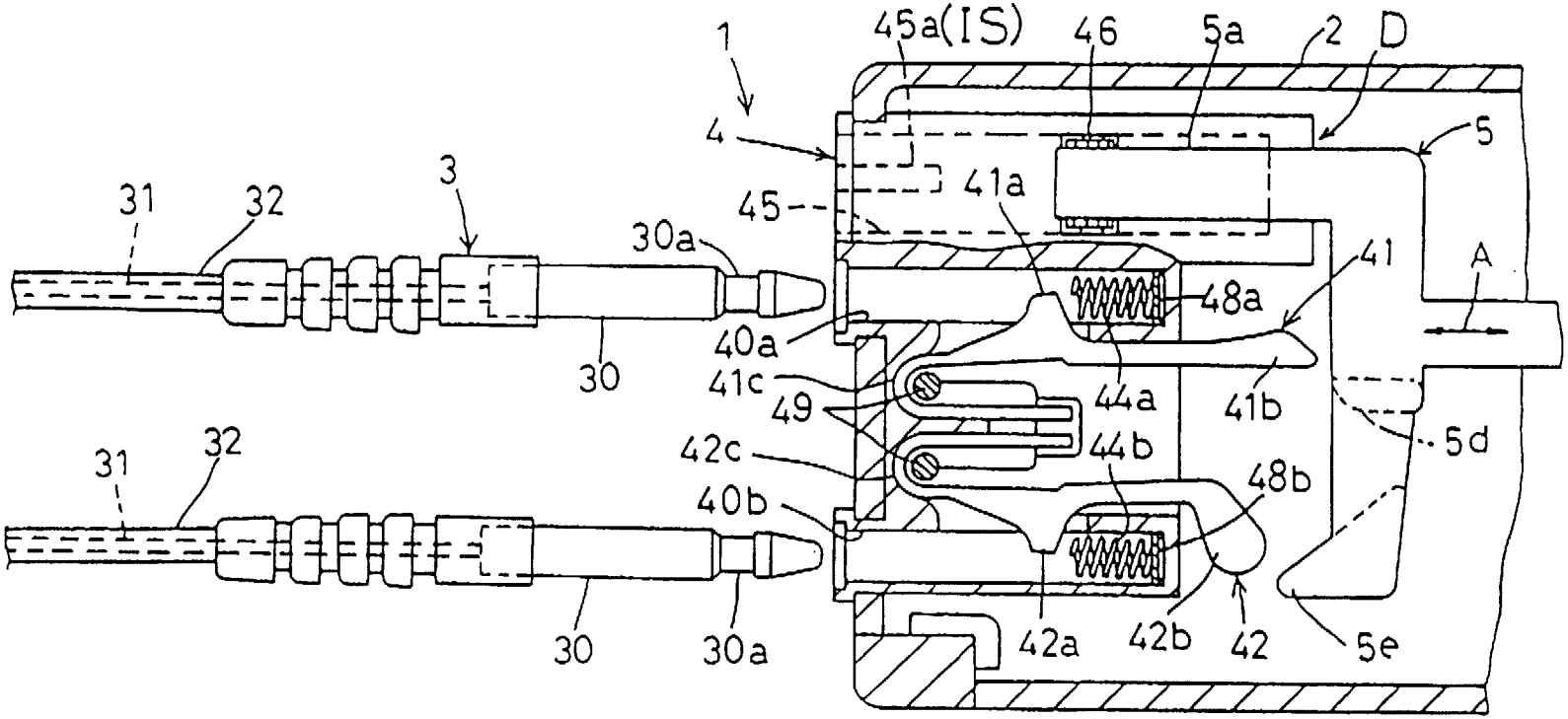
FIG. 6 is an enlarged view of principal portions relating to the embodiment of the present invention.

The wire unit 3, as shown in FIG. 6, includes lock pins 30 provided at opposed ends for inserting and withdrawing the box 2, wires 31 for respectively connecting the lock pins 30 and outer sheaths 32 for coating portions of the wires 31 and lock pins 30.

The lock pin 30 and wire 31 are made of metal thus having conductivity, and the lock pins 30 at the opposed ends are also electrically connected to the box. Further, adjacent a leading end of each lock pin 30, there is formed an engaging concave portion 30*a* for preventing withdrawal of the lock pin 30 from the box 2.

Figure 7:
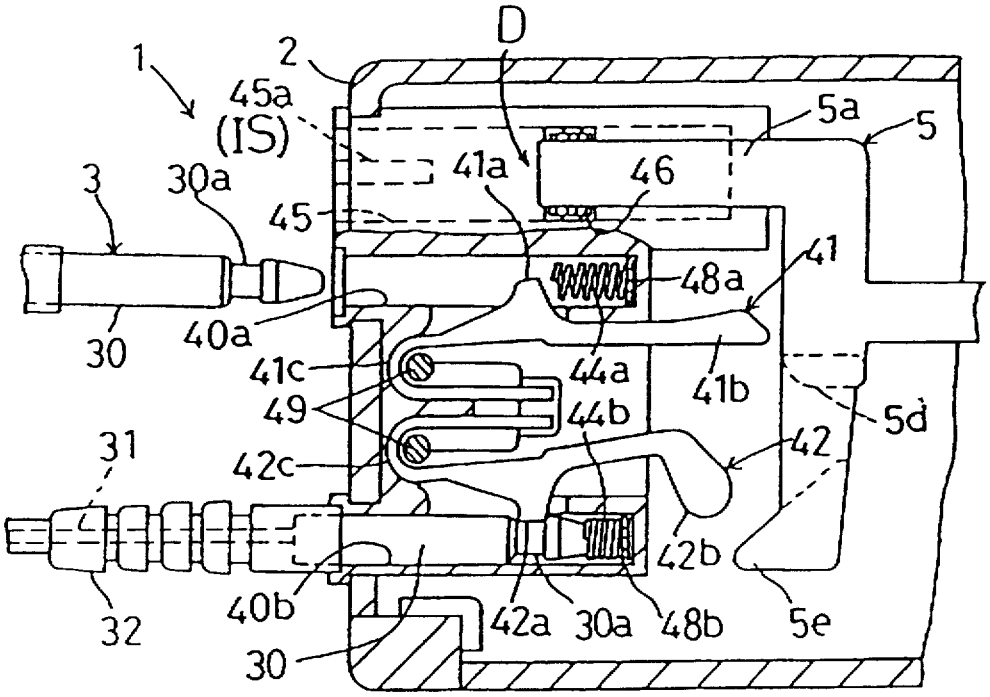
FIG. 7 is an enlarged view of principal portions relating to the embodiment of the present invention.

As shown in FIG. 7 or the like, the end of the outer sheath 32 covering the lock pin 30 is constructed so as to be slightly dipped into the box 2 when the lock pin 30 is inserted into the box 2, thereby to prevent the lock pin 30 being from exposed to the outside. With this, it is possible to prevent the lock pin 30 from coming into contact with an electrostatically charged external object thereby to damage the electric circuitry inside the box 2.

Figure 2:
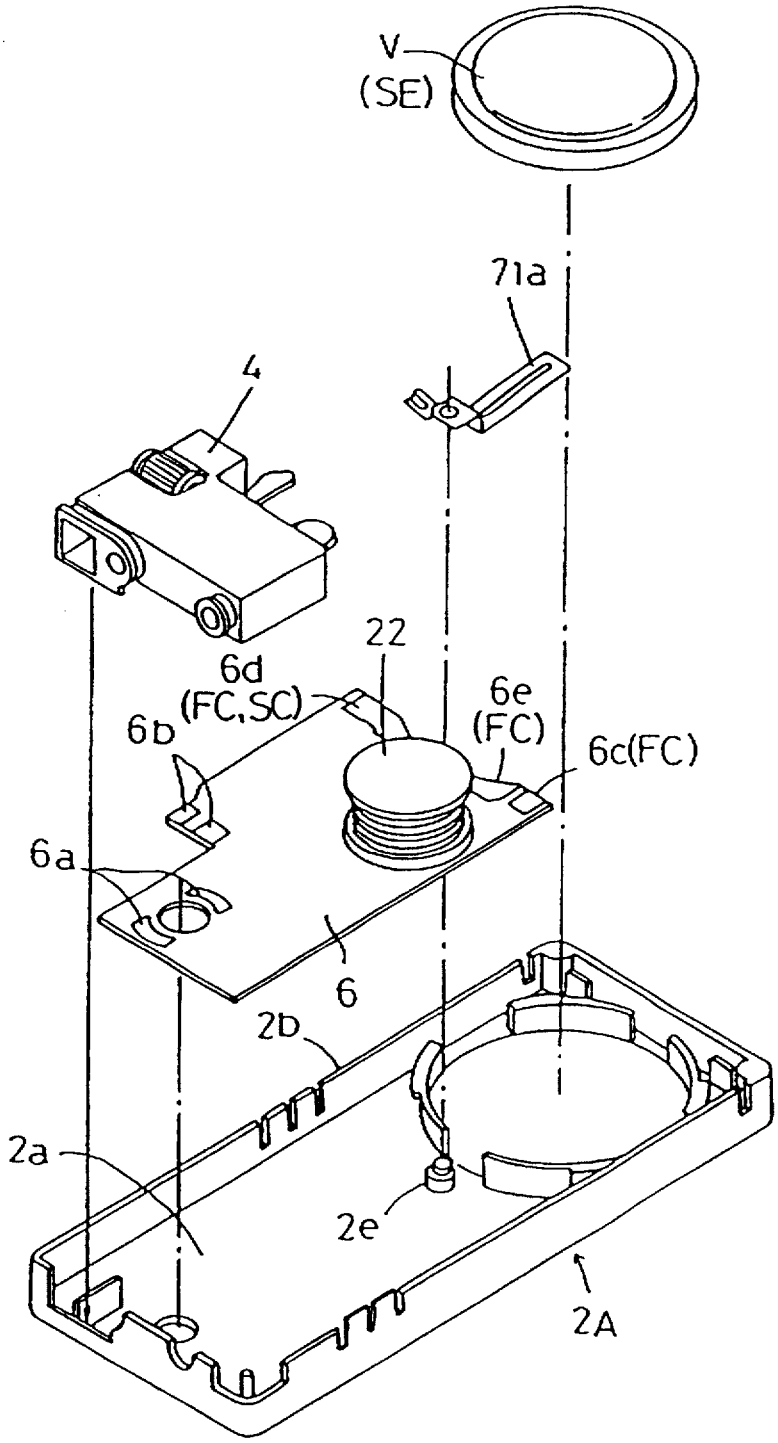
FIG. 2 is an exploded perspective view of a bottom case portion of a box relating to the embodiment of the present invention.
Figure 3:
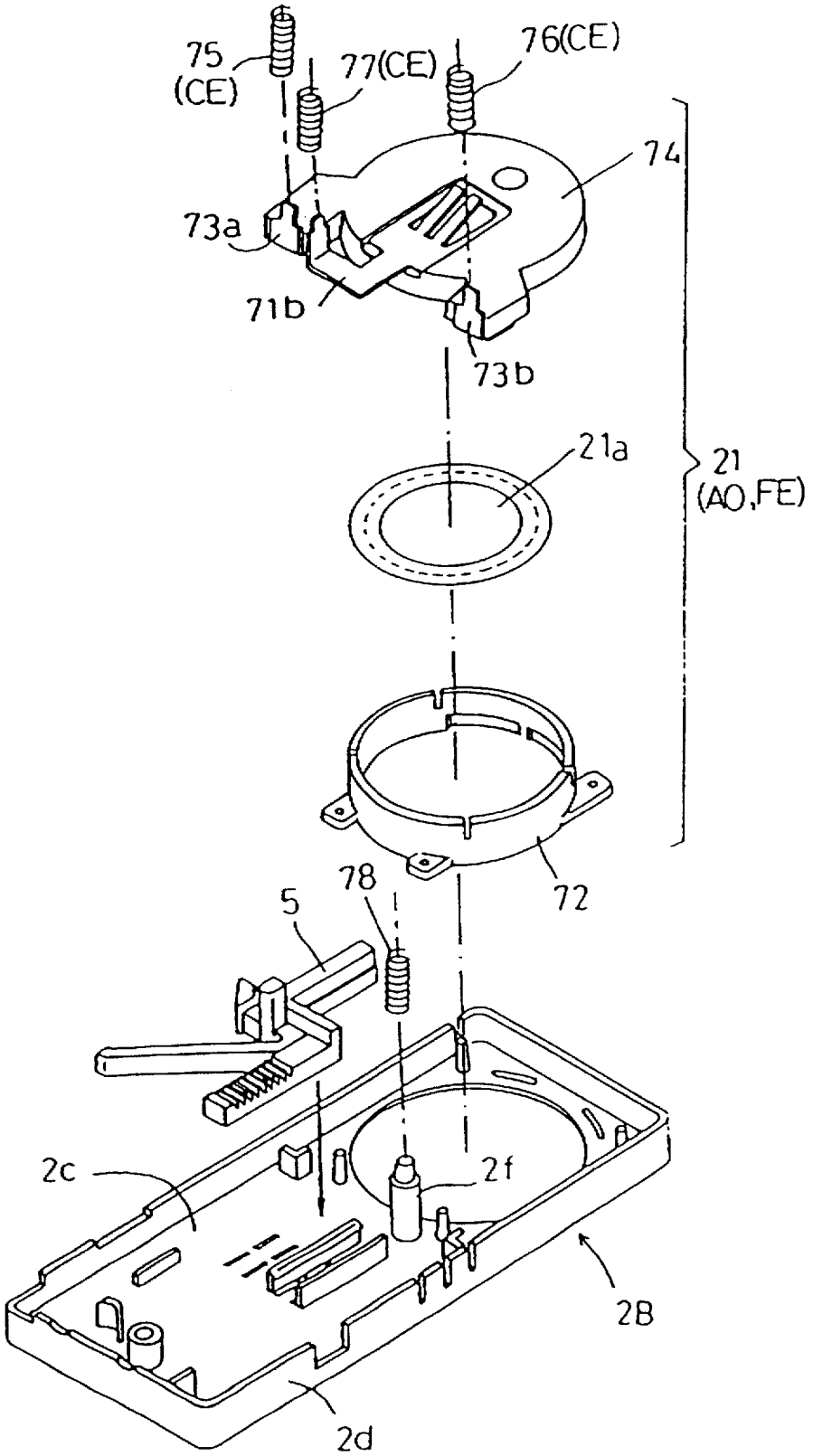
FIG. 3 is an exploded perspective view of a top case portion of the box relating to the embodiment of the present invention.

As shown in FIG. 2 and FIG. 3, the box includes a bottom case 2*a* as a first casing member and a top case 2B as a second casing member.

The bottom case 2A includes a first wall member 2*a* having substantially rectangular shape and a cylindrical wall portion 2*b* projecting substantially perpendicularly from the periphery of the first wall member 2*a*. The top case 2B includes a second wall portion 2*c* having substantially rectangular shape and a cylindrical wall portion 2*d* projecting substantially perpendicularly from the periphery of the second wall member 2*c*.

The box 2 is assembled with opposed end faces of the bottom case 2A and top case 2B, i.e. the leading ends of the two wall portions 2*b*, 2*d* being fused to each other by means of supersonic welding or the like.

Under this assembled condition, the first wall portion 2*a* and the second wall portion 2*c* as a pair together constitute a pair of wall portions of the box 2.

Figure 5:
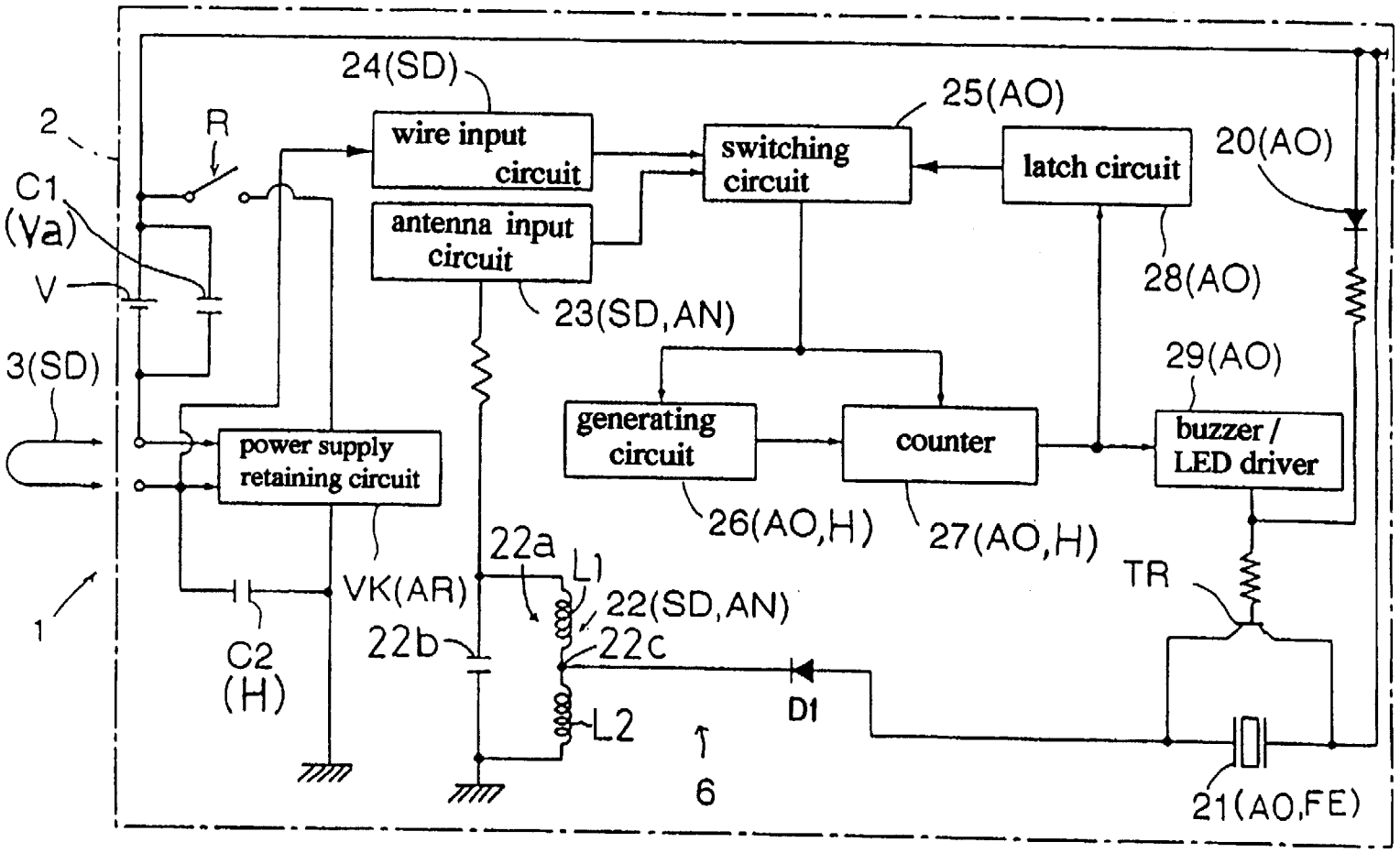
FIG. 5 is a circuit construction diagram relating to the embodiment of the present invention.

Though will be detailed later, inside the box 2, there is provided alarm output means AO for outputting alarm information in the form of sound and light when a preliminary stealing act is detected. And, this alarm output means AO, as shown in FIG. 5, includes a circuit board 6 mounting various circuits and various electronic components, a piezoelectric buzzer 21 as a disc-shaped alarm buzzer, a disc-shaped button battery (may be referred to simply as a battery hereinafter) V and so on. Inside the box 2, in addition to the alarm output means AO, such components as a jack unit 4 and a slider 5, (see FIG. 6) are provided.

Figure 11:
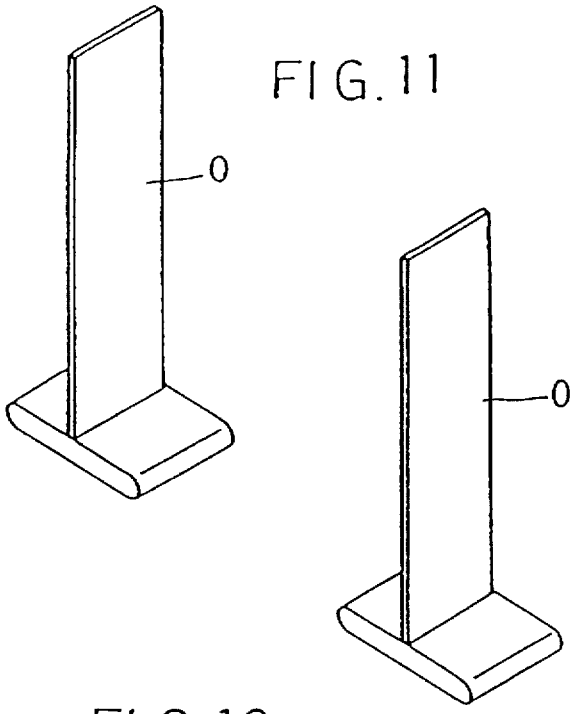
FIG. 11 is a view showing outer appearance of a transmitter relating to the embodiment of the present invention.

The various circuits mounted on the circuit board 6 are constructed such that the piezoelectric buzzer 21 is sounded to issue an alarm, when the box 2 is attached to e.g. a commodity as an object of theft prevention via the wire unit 3, of the wire unit 3 is cut off or if the sensor tag 1 is carried past the installed site of a pair of panel-like transmitters O as shown in FIG. 11 installed at a predetermined site such as opposed sides of an entrance/exit of a shop. Incidentally, as the transmitters O, only one of the pair of panel type may be disposed at one side of the entrance/exit or on a floor face of the entrance/exit.

Next, with reference to FIGS. 2 and 3, the construction of incorporating the above-described respective components within the box 2 and the electric connecting constructions among the piezoelectric buzzer 21, the battery V and the circuit board 6 will be described.

The first wall portion 2*a* of the bottom case 2A of the box 2 supports the circuit board 6 and also incorporates the jack unit 4, a connecting terminal 71*a* as a power-supply relay member for electrically connecting the positive terminal of a battery V and the circuit board 6 and the battery V. The connecting terminal 71*a* is fixed to a boss 2e defined in the bottom case 2A.

The second wall portion 2*c* of the top case 2B of the box 2 supports the piezoelectric buzzer 21 as a constituting element of the alarm output means AO and also incorporates the slider 5.

The piezoelectric buzzer 21, as shown in FIG. 3, includes a vibrating member 21*a*, a buzzer case 72 housing the vibrating member 21*a*, and a flat-plate terminal portion 74 including two buzzer terminals 73*a*, 73*b* for impressing a voltage to the vibrating member 21*a*. On the side of the terminal portion 74 away from the vibrating member 21*a*, i.e. on the outer face of the piezoelectric buzzer 21, there is attached a connecting terminal 71*b* for connection with the negative terminal of the battery. Incidentally, the connecting terminals 71*a*, 71*b* are provided with a returning urging force for pressing the battery, at the position thereof contacting the battery V.

And, at the projection-like circuit board connecting portions provided respectively to the buzzer terminals 73*a*, 73*b* and the connecting terminal 71*b*, coil springs 75, 76 and 77 having conductivity and returning urging force are fitted outwardly. And, a pressing coil spring 78 is outwardly fitted to the boss 2*f* defined in the top case 2B. Then, in this condition, the bottom case 2A and the top case 2B are assembled with each other.

Figure 4:
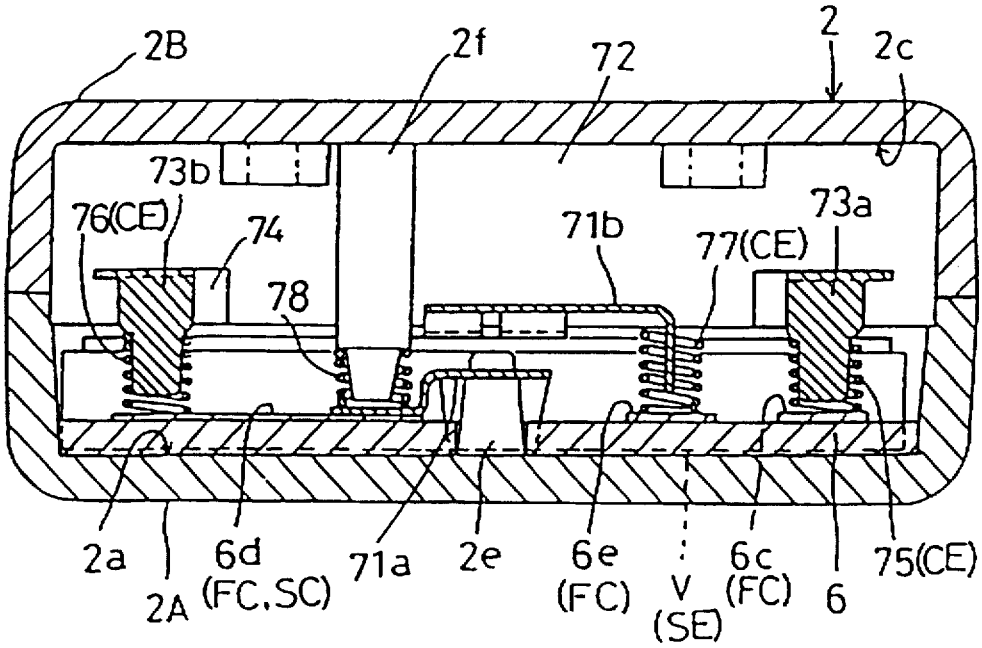
FIG. 4 is a vertical section view of the box relating to the embodiment of the present invention.

Then, the respective coil springs 75, 76, 77 and the pressing coil spring 78 are compressed than their maximally expanded states, so that, as shown in FIG. 4, the buzzer terminal 73 and a connecting electrode pad 6*c* provided correspondingly on the circuit board 6 are electrically connected with each other via the coil spring 75, the buzzer terminal 73*b* and an electrode pad 6*d* provided correspondingly on the circuit board 6 are electrically connected with each other via the coil spring 76 and the connecting terminal 71*b* and an electrode pad 6*e* provided correspondingly on the circuit board 6 are connected with each other via the coil spring 78. Also, the connecting terminal 71*a* and the connecting terminal 71*b* are contacted and electrically connected with the positive and negative terminals of the battery V, respectively. Hence, the piezoelectric buzzer 21, the battery V and the circuit board 6 are electrically connected.

Under this condition, the battery V is retained as being bound between the first wall portion 2*a* and the piezoelectric buzzer 21.

As described above, the constructions for incorporating the respective components within the box 2 and the constructions connecting the piezoelectric buzzer 21, the battery V and the circuit board 6 are provided as electric connecting constructions, the incorporating and connecting operations can be simple without such troublesome operations as welding. Moreover, the returning urging forces provided by the respective coil springs can provide reliable electric connections.

Accordingly, the piezoelectric buzzer 21 functions as a first-kind constituting element FE of the alarm output means AO. The coil springs 75, 76, 77 function as power-supply contact members CE formed integrally with the first-kind constituting element FE. And, the electrode pads 6*c*, 6*e*, 6*d* function as a first-kind contact of the circuit board 6 having a contact face extending toward the second wall portion 2*c* side.

The disc-shaped battery V functions as a second-kind constituting element SE of the alarm output means AO. The electrode pad 6*d* functions as a second contact SC of the circuit board 6 having a contact face extending toward the second wall portion 2*c* side. And, one end of the connecting terminal 71*a* as the power-supply relay member is pressed against the second-kind contact SC by means of the pressing coil spring 78 supported to the second wall portion 2*c*.

Next, additional description will be made on the circuit board 6.

As shown in FIG. 5, on the circuit board 6, there are provided an LED lamp 20, a resonance antenna 22 including a coil 22*a* and a capacitor 22*b*, a power supply capacitor C1 connected in parallel with the battery V, an antenna input circuit 23 for outputting a reception signal when the resonance antenna 22 becomes a receiving state, a wire input circuit 24 for outputting a wire cut signal when the wire unit 3 is not connected properly, a switching circuit 25 for outputting a control signal when receiving a reception signal from the antenna input circuit 23 or a wire cut signal from the wire input circuit 24, a generating circuit 26 starting pulse generation in response to input of a control signal from the switching circuit 25, a counter 27 for starting count of the number of pulses generated by the generating circuit 26 in response to input of the control signal from the switching circuit 25 and outputting a count completion signal when the counted number exceeds a predetermined count number, a latch circuit 28 for retaining the switching circuit 25 at the state at the time of input of the reception signal or wire cut signal in response to input of the count completion signal from the counter 27, a buzzer/LED driver 29 for illuminating the LED lamp 20 and sounding the piezoelectric buzzer 21 in response to input of the count completion signal from the counter 27, and a power supply retaining circuit VK operable to initiate power supply from the battery V to the respective circuits by connecting the negative terminal with the ground terminals of the respective circuits in association with insertion of the wire unit 3 into the box 1 and then retaining the power supply unless a reset switch R is closed once the power supply is initiated.

With the above-described electrical connecting constructions, the circuit board 6 and the battery V and also the circuit board 6 and the piezoelectric buzzer 21 are electrically connected, respectively, so that power is supplied from the battery V to the respective circuits.

The piezoelectric buzzer 21 is driven by periodic voltage pulses and generates a sound according to the frequency of the voltage pulses.

As the buzzer/LED driver 29 generates the periodic voltage pulse signals, the output signals from this buzzer/LED driver 29 may directly drive the piezoelectric buzzer 21. Yet, the greater the voltage value of the voltage pulses to applied thereto, the greater sound the piezoelectric buzzer 21 generates. Then, there is provided a booster circuit so as to be able to apply boosted voltage pulses to be applied on the piezoelectric buzzer 21.

Next, the construction of this booster circuit will be described.

The booster circuit includes the transistor TR which effects the switching operation in response to the output signal from the buzzer/LED driver 29, a diode D1 for preventing input from a current from the resonance antenna 22 and a portion of the coil 22*a*.

The coil 22*a* of the resonance antenna 22 comprises a center tap type coil, such that it may be used as two coils L1, L2 with an electrode terminal 22*c* being withdrawn from a middle portion of the continuously wound coil.

This electrode terminal 22*c* is connected via the diode D1 with the piezoelectric buzzer 21, such that the piezoelectric buzzer 21 and the coil L2 are serially connected with each other. The piezoelectric buzzer 21 has a construction in which a dielectric is bound between electrodes and this is an electrically capacitive buzzer. Then, this may be considered to be equivalent to a capacitor. Accordingly, the piezoelectric buzzer 21 and the coil L2 together constitute a serial resonance circuit.

The buzzer/LED driver 29 outputs the voltage pulse, and this outputted voltage pulse is inputted to a base of the transistor TR in which the piezoelectric buzzer 21 is connected between the collector and emitter thereof.

Figure 20A:
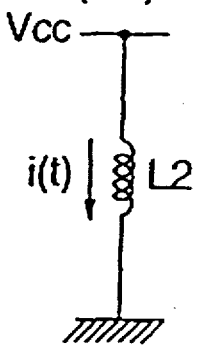
Figure 20B:
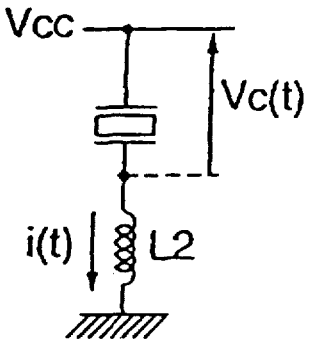

When the transistor TR which effects the switching operation by the voltage pulse from the buzzer/LED driver 29 is in the state of 'ON', as shown in FIG. 20(*a*), there is equivalently realized a condition where the coil L2 alone is present between a supply voltage Vcc of the battery V and the ground (GND). Whereas, when the transistor TR is in the state of 'OFF', as shown in FIG. 20(*b*), there is equivalently realized a condition where the piezoelectric buzzer 21 and the coil L2 are serially present between the supply voltage Vcc and the ground (GND).

Figure 21:
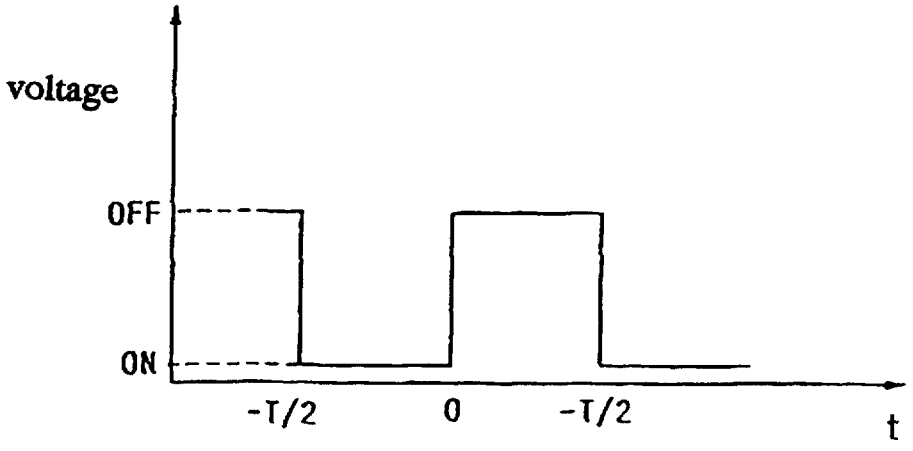
FIG. 21 is an operation descriptive view of the booster circuit relating to the embodiment of the present invention, FIGS. 22(*a*), (*b*) are views showing a sensor tag relating to a further embodiment of the present invention.

Supposing: the voltage at the opposed ends of the piezoelectric buzzer 21 is $v_c(t)$; the current running in the coil L2 is i(t); the capacitance of the piezoelectric buzzer 21 is C; the buzzer/LED driver 29 outputs a voltage pulse signal as shown in FIG. 21 having a cycle of T and a duty of 50%, and if the transistor TR is switched; then, under the 'ON' state shown in FIG. 20(*a*) of the transistor TR, i.e. the condition of (−T/2<t<0) in FIG. 21, there is provided:

$$v_c(t) = 0$$

$$i(t) = \frac{Vcc}{R}\{1 - e^{\frac{-R}{L}(t+T/2)}\}$$

Whereas, in the condition: t=0, i.e. the current $i_0$ running in the coil L2 at the moment of the switchover of the transistor TR from 'ON' to 'OFF' is:

$$i_0 = i(0) = \frac{Vcc}{R}\left(1 - e^{\frac{-RT}{2L}}\right) \quad \text{expression 1}$$

In the 'OFF' state shown in FIG. 20(*b*) of the transistor TR, i.e. in the condition shown in FIG. 21 of (0<t<T/2), with the above expression 1 as the initial conditions, the condition will be as expressed by the following expression 2 expression 2

$$i(t) = \frac{Vcc}{R} e^{-\frac{R(t+T)}{2L}} \left\{ \left( e^{\frac{RT}{2L}} - 1 \right) \cos\omega t + \frac{R}{\omega L} \sin\omega t \right\}$$

$$v_c(t) = Vcc \left[ 1 - e^{-\frac{R}{2L}t} \cos\omega t + e^{-\frac{R}{2L}t} \left\{ \frac{\omega L}{R}\left(1 - e^{\frac{-RT}{2L}}\right) - \frac{R}{4\omega L}\left(1 + e^{\frac{-RT}{2L}}\right) \right\} \sin\omega t \right]$$

$$\omega = 1/\sqrt{LC} \cdot \sqrt{1 - \frac{R^2C}{4L}}$$

In the expression 2, $v_c(t)$ is at maximum when $\sin\omega t=1$, and if, e.g. the frequency of the sound generated from the piezoelectric buzzer 21 is 4 kHz, i.e. T=250 μs, R=100 Ω, L=50 mH, C=15 nF, this peak voltage $v_c^P$ will be:

$$v_c^P = 4.8\ Vcc$$

Accordingly, the voltage pulse boosted above the power voltage Vcc is applied to the piezoelectric buzzer 21, so that the sound generated from the piezoelectric buzzer 21 is increased in volume.

Incidentally, the coil 22*a* of the resonance antenna 22 is wound about an axis extending in the thickness direction in order to be able to detect most effectively change in the magnetic field in the direction of thickness of the box 2 having the flat rectangular shape.

According to the circuitry construction described above, when the box 2 is attached to a commodity as the object of theft prevention via the wire unit 3, if the wire unit 3 is cut or if the sensor tag 1 is passed through an installed site of a pair of panel type transmitters O as shown in FIG. 11 which are to be installed at e.g. opposed ends of an entrance/exit of a shop, the piezoelectric buzzer 21 housed in the box 2 is activated to generate a sound for outputting alarm. Incidentally, as the transmitters O, one of the above-described pair of panel type may be disposed at one side of the entrance/exit or on a floor face of the entrance/exit.

Next, process until the piezoelectric buzzer 21 begins to generate the sound in case the wire unit 3 is cut off or the sensor tag 1 is carried past the installed site of the pair of panel-like transmitters O as shown in FIG. 11 installed at opposed sides of an entrance/exit of a shop or the like will be described briefly.

First, when the wire unit 3 and the box 2 are not serially connected, such as when the wire unit 3 is cut off, at the input terminal of the wire input circuit 24, the potential rises from the ground potential. When the input terminal of the wire input circuit 24 has risen above a predetermined voltage, the wire input circuit 24 detects this as e.g. cut-off of the wire unit 3.

Upon detection of e.g. cut-off of the wire unit 3, the wire input circuit 24 outputs a wire cut signal to the switching circuit 25.

Incidentally, the input side of the wire input circuit 24 is connected with the ground via a delay capacitor C2. Thus, even if there occurs disconnection at contacts of the circuits between the wire unit 3 and the box 2 due to e.g. application of vibration to the wire unit 3, rapid rise of the potential at the input side of the wire input circuit 24 may be restricted. As a result, the wire input circuit 24 is prevented from being erroneously activated when the wire unit 3 is not cut off.

The switching circuit 25 continuously provides a control signal to the generating circuit 26 and to the counter 27 while receiving the wire cut signal. And, while receiving this control signal, the generating circuit 26 keeps generating pulses and the counter 27 counts the number of these pulses generated from the generating circuit 26. Then, when the control signal is stopped, the generating circuit 26 stops pulse generation and the counter 27 stops pulse counting and rests the pulse count number.

After each completion of count of a predetermined number of pulses, the counter 27 transmits a single pulse signal as a count completion signal to the latch circuit 26 and to the buzzer/LED driver 29.

While receiving this count completion signal, the buzzer/LED driver 29 sounds the piezoelectric buzzer 21 and also illuminates the LED lamp 20.

On the other hand, upon reception of the count completion signal from the counter 27, the latch circuit maintains the switching circuit 25 under the condition at the time of the reception of the cut signal, whereby the switching circuit 25 keeps transmitting the control signal to the generating circuit 26 and to the counter 27.

That is to say, after the switching circuit 25 receives the cut signal and then after the counter 27 has completed count of the predetermined pulse number, the buzzer/LED driver 29 sounds the piezoelectric buzzer 21 and illuminates the LED lamp 20. With this, the piezoelectric buzzer 21 and the LED lamp 20 are not activated unless continuously receiving the cut signal for a predetermined period of time, so that erroneous activations thereof due to e.g. noise are avoided.

Once the counter 27 has transmitted the count completion signal, regardless of presence/absence of the cut signal from the wire input circuit 24, the switching circuit 25 keeps transmitting the control signal. Thus, until the reset switch R is closed, the piezoelectric buzzer 21 keeps generating the sound intermittently in synchronism with the count completion signal from the counter 27 and the LED lamp 20 keeps illuminating intermittently in synchronism with the count completion signal from the counter 27.

The power supply capacitor C1 connected parallel with the battery V is charged by this battery V.

Even if a shock or vibration is applied to the box 2 while the LED lamp 20 and the piezoelectric buzzer 21 are issuing the alarm, the functions of the coil spring 77 and the pressing coil spring 78 prevent the positive and negative terminals of the battery V from being electrically disconnected from the circuit board 6. However, even if such disconnection should occur with interruption of the power supply to the respective circuits from the battery V, the power-supply capacitor C1 continuously supplies power in place of the battery V. Thus, it is possible to prevent the respective circuits inside the box 2 from being reset to stop the alarm. When the positive or negative terminal of the battery V is momentarily detached from the connecting terminal 71*a*, 71*b* and then contacted with the terminal again, the power supply capacitor C1 is charged by the battery V, so that electric power is stored in the power supply capacitor C1.

Incidentally, as the power supply capacitor C1 is electrically connected with the circuit board 6 by means of e.g. welding, there occurs no electrical disconnection even if impact or vibration is applied thereto.

When the sensor tag 1 is passed through the installed site of the transmitters O, an electromotive force is generated in the resonance antenna 22 due to the radio wave from the transmitters O. So that, the antenna input circuit 23 detects this electromotive force and outputs a reception signal to the switching circuit 25.

The operations of the respective circuits after the switching circuit 25 has received the reception signal are the same as those in the afore-described case when the wire unit 3 is cut off and therefore will not be described here.

Accordingly, the wire input circuit 24 functions as attachment/detachment detecting switch for electrically detecting attachment and detachment of the wire unit 3 to and from the box 2. Further, the resonance antenna 22 and the antenna input circuit 23 function as an antenna disposed inside the box 2 for receiving radio wave from a transmitter O installed at a predetermined site.

The preliminary act detecting means SD for detecting a preliminary stealing act such as unlawful detachment of the sensor tag from the object of theft prevention by cutting off the wire unit 3 or attempt to unlawfully take out he object of theft prevention to which the sensor tag 1 is attached to the outside of the shop include the wire unit 3, the resonance antenna 22, the antenna input circuit 23 and the wire input circuit 24.

The switching circuit 24, the generating circuit 26, the counter 27, the latch circuit 28, the buzzer/LED driver 29, the LED lamp 20 and the piezoelectric buzzer 21 together function as the alarm output means AO for outputting the alarm information in the form of light and sound based on preliminary stealing act detection information of the preliminary act detecting means SD. This alarm output means AO is constructed so as to output the alarm information based on the wire cut-off signal (corresponding to a detachment detection signal) from the wire input circuit 24 and the reception signal from the resonance antenna 22 and the antenna input circuit 23 as the preliminary stealing act detection information.

With being charged by the battery V, the power supply capacitor C1 functions as an auxiliary power supply means Va for driving the preliminary act detecting means SD and the alarm output means AO when the power supply from the battery V is interrupted.

Incidentally, checking means H for allowing the alarm output means AO to issue the alarm information only when the preliminary stealing act detection information outputted from the preliminary stealing act detecting means SD continues over a predetermined period of time is constituted from the delay capacitor C2, the generating circuit 26 and the counter 27.

Next, attaching construction of the wire unit 3 to the box 2 will be described.

As shown in FIGS. 6 through 10, the wire unit 3 is attached to the box 2, with the lock pins 30 of the wire unit 3 being inserted into two lock pin insertion holes 40*a*, 40*b* of a jack unit 4 provided in contact with the inner wall of the box 2.

The jack unit 4 includes a hook-shaped lock spring 41 for engaging the lock pin 30 inserted into the lock pin insertion hole 40*a* for preventing withdrawal of the pin and a hook-shaped lock spring 42 for engaging the lock pin 30 inserted into the lock pin insertion hole 40*b* for preventing withdrawal of the pin, with the springs 41, 42 being provided side by side.

The lock springs 41, 42, as lock means, are retained at curved portions 41*c*, 42*c* thereof to spring retaining projections 49 projecting from the body of the jack unit 4.

At intermediate positions between distal ends 41*b*, 42*b* away from the curved portions 41*c*, 42*c* of the lock springs 41, 42 and the curved portions 41*c*, 42*c*, there are provided convex portions 41*a*, 42*a* engageable with engaging concave portions 30*a* of the lock pins 30, with the convex portions being to projectable into and withdrawable from the lock pin insertion holes 40*a*, 40*b*, as will be described later.

The lock springs 41, 42 respectively are made of metal and have the hook shape, so that each spring has elasticity in the direction that the opposed ends thereof move toward or away from each other. Thus, when no force is applied to the lock spring 41, 42, as shown in FIG. 6, the convex portion 41*a*, 42*a* projects to the substantially middle position at the lock pin insertion hole 40*a*, 40*b*.

Accordingly, when the engaging concave portion 30*a* of the lock pin 30 engages with the convex portion 41*a*, 42*a*, the convex portion 41*a*, 42*a* is pushed away from the lock pin insertion hole 40*a*, 40*b*, whereby the lock spring 41, 42 is urged toward the side for engagement with the lock pin 30.

The lock pin insertion hole 40*a*, 40*b* is closed at the bottom side thereof, where a metal coil spring 44*a*, 44*b* having one end fixed to the bottom end of the lock pin insertion hole 40*a*, 40*b* is provided.

The metal coil springs 44*a*, 44*b* function to urge the lock pins 30 respectively inserted into the lock pin insertion holes 40*a*, 40*b* toward the disengaging side and these springs are in contact, at the fixed ends thereof, with metal conductive terminals 48*a*, 48*b*.

Figure 12:
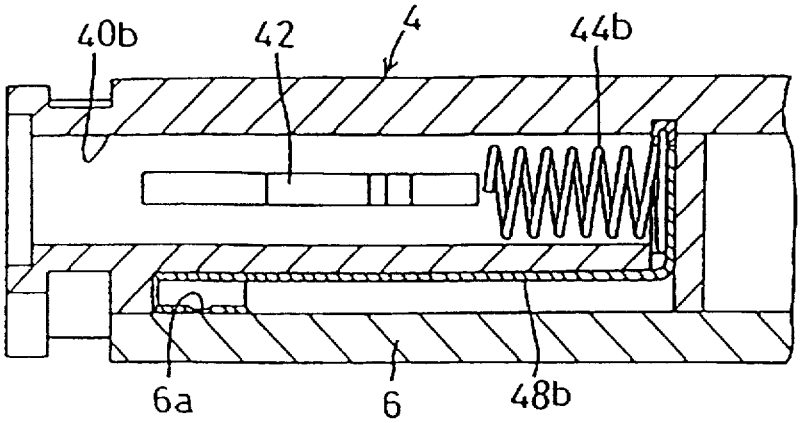
FIG. 12 is an enlarged view of principal portions relating to the embodiment of the present invention.

The conductive terminal 48*b*, as shown in FIG. 12, has its one end projecting to the bottom end of the lock pin insertion hole 40*b* to contact the coil spring 44*b* and has its other end contacting an electrode face 6*a* formed in the circuit board 6.

Incidentally, the other conductive terminal 48*a* too, though different in its connecting position to the circuit board 6, has substantially same construction as the conductive terminal 48*b*.

With this, the lock pins 30 inserted into the lock pin insertion holes 40*a*, 40*b* are electrically connected, via the coil springs 44*a*, 44*b* and the conductive terminals 48*a*, 48*b*, with the circuitry shown in FIG. 5.

At a portion of the lock pin insertion hole 40*a* opposite to the lock pin insertion hole 40*b*, a key insertion hole 45 as an insertion hole for releasing operation is formed to extend from the outer side to the inner side of the box 2. And, into this key insertion hole 45, a rack portion 63 of an engagement releasing key K as a releasing tool to be described later is to be inserted.

At the position of the lock pin insertion hole 40*a* opposite to the lock pin insertion hole 40*b*, there is provided engagement releasing means D for operating the lock springs 41, 42 to the engagement releasing side by means of the engagement releasing key K as the engagement releasing tool. For this engagement releasing means D, the key insertion hole 45 as the insertion hole for releasing operation is formed from the outer face to the inside of the box 2.

Figure 13:
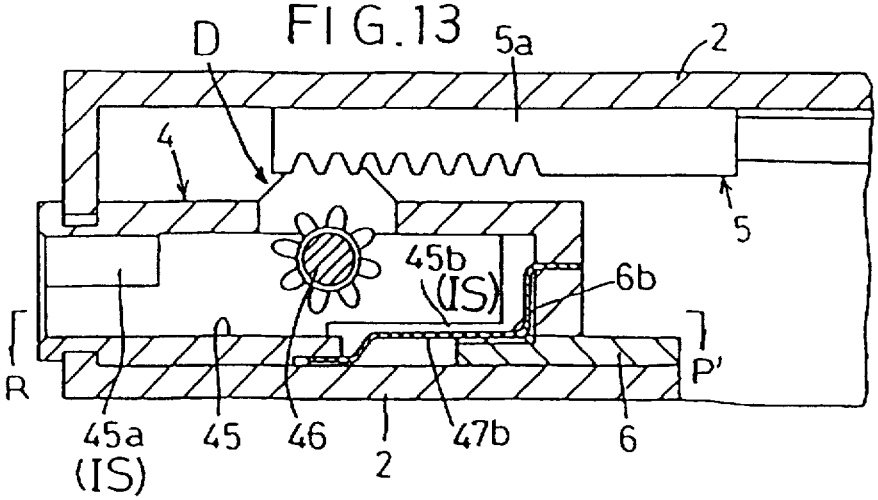
FIG. 13 is an enlarged view of principal portions relating to the embodiment of the present invention.
Figure 14:
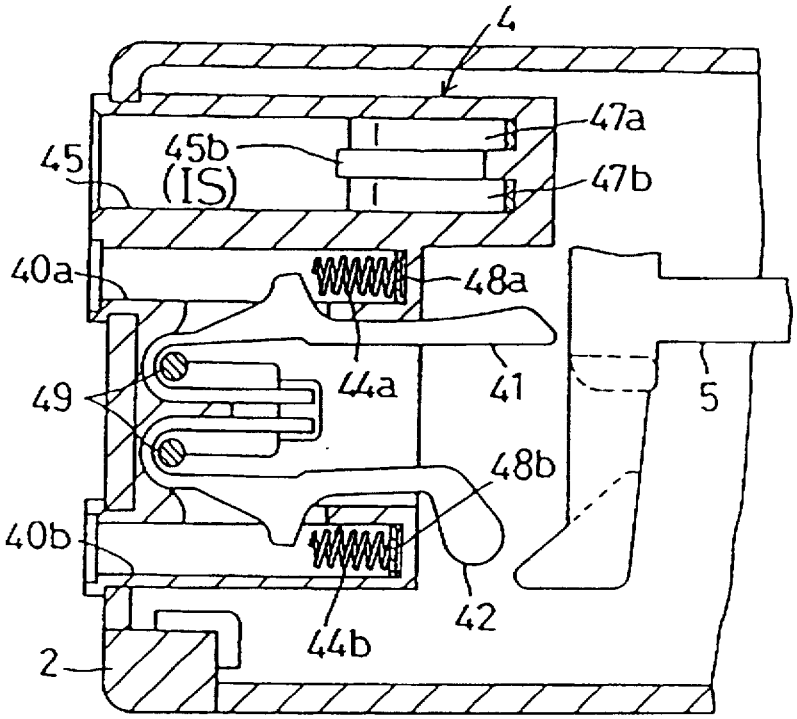
FIG. 14 is an enlarged view of principal portions relating to the embodiment of the present invention.
Figure 15:
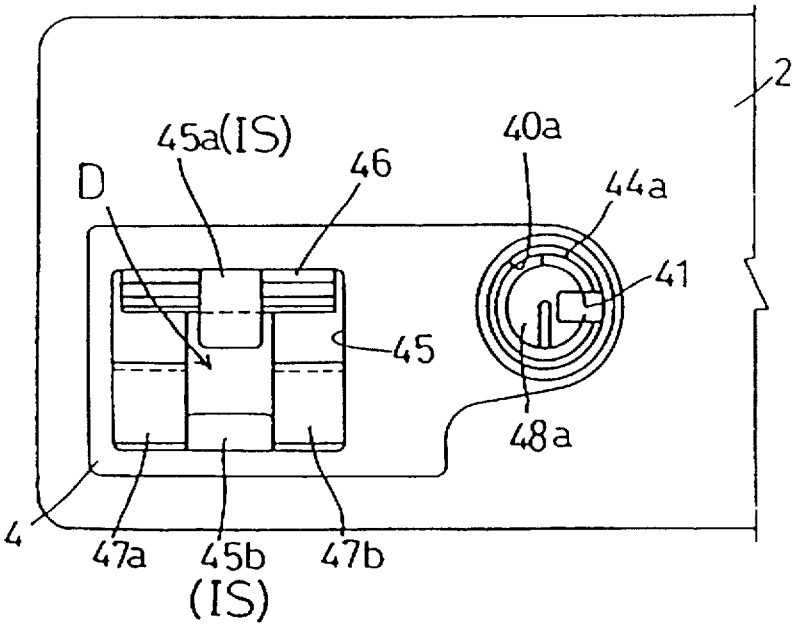
FIG. 15 is an enlarged view of principal portions relating to the embodiment of the present invention, FIGS. 16(*a*), (*b*), (*c*) are enlarged views of principal portions of an engagement releasing key relating to the embodiment of the present invention, FIGS. 17 (*a*) and (*b*) are enlarged views of principal portions of an engagement releasing key relating to the embodiment of the present invention.

As shown in FIG. 13, FIG. 14 which is a section view taken along P–P' in FIG. 13, and also in FIG. 15 which shows the key insertion hole 45 as viewed from the outer side thereof, the key insertion hole 45 incorporates therein a pinion gear 46 rotatably operated in association with the insertion of the rack portion 63 of the engagement releasing key K into the key insertion hole 45 and a pair of reset terminals 47*a*, 47*b* forming a part of the reset switch R shown in FIG. 5, and also two blocking walls 45*a*, 45*b* as projections projecting from the side wall of the key insertion hole 45 to the inside of the key insertion hole 45 are formed at different longitudinal positions at the entrance side and the bottom side of the key insertion hole 45.

The pinion gear 46 is rotatably supported to the body of the jack unit 4 with the teeth thereof extending in the direction normal to the inserting direction of the rack portion 63 of the engagement releasing key K, and with the pinion gear being slightly movable in the direction normal to the plane of FIGS. 6 through 10. Further, when the rack portion 63 of the engagement releasing key K is not inserted into the key insertion hole 45, the pinion gear 46 is located on the inner side relative to the key insertion hole 45, not engaging with a rack portion 5*a* of the slider 5 to be described later. Whereas, when the rack portion 63 of the engagement releasing key K is inserted into the key insertion hole 45, the pinion gear is pushed up by the rack portion 63, so that a portion thereof projects outside the jack unit 4 to engage with the rack portion 5*a* of the slider 5.

The pair of reset terminals 47*a*, 47*b* are provided on the opposed sides of the bottom side blocking wall 45*b* of the two blocking walls 45*a*, 45*b* to be exposed inside the key insertion hole 45. Further, as shown in FIG. 13, the terminals are exposed also to the outside of the jack unit 4, so that these portions exposing to the outside respectively contact with the electrode face 6*b* formed in the circuit board 6 to be connected with the circuitry shown in FIG. 5.

The entrance side blocking wall 45*a* of the two blocking walls 45*a*, 45*b*, is formed as a projecting ridge extending from the entrance end of the key insertion hole 45 longitudinally toward the bottom side of the key insertion hole 45, and formed more particularly as an erect plate member.

The bottom side blocking wall 45*b*, as shown in FIG. 13, is formed as a substantially L-shaped plate member, and a portion thereof formed along the side face of the key insertion hole 45 as viewed from the longitudinal direction, is provided as a projecting ridge extending in the longitudinal direction of the key insertion hole 45, like the entrance side blocking wall 45*a*.

The entrance side blocking wall 45*a* and the bottom side blocking wall 45*b*, as shown in FIG. 15, are formed with 180 degree phase difference therebetween, if positions at the inner wall of the key insertion hole 45 as viewed in the longitudinal direction are expressed in terms of phase relative to a virtual circle centering about the longitudinal center of the key insertion hole 45.

The bottom side blocking wall 45*b*, through the entire region where the pair of reset terminals 47*a*, 47*b* are exposed inside the key insertion hole 45, is located between the pair of reset terminals 47*a*, 47*b*. Also, the height of the blocking wall 45*b* from the wall face of the key insertion hole 45 is designed to be higher than the height of the pair of reset terminals 47*a*, 47*b* from the wall face of the key insertion hole 45, thus constituting a non-conductive partitioning portion for preventing the pair of reset terminals 47*a*, 47*b* from being rendered conductive with unlawful insertion of a metal plate.

When the pair of reset terminals 47*a*, 47*b* are short-circuited, the reset switch R in the circuitry shown in FIG. 5 is closed to stop the power supply from the battery V to the respective circuits. Therefore, by forming the blocking wall 45*b* in the above-described manner, the pair of reset terminals 47*a*, 47*b* are prevented from being easily short-circuited with insertion of an external object having conductivity.

Figure 19:
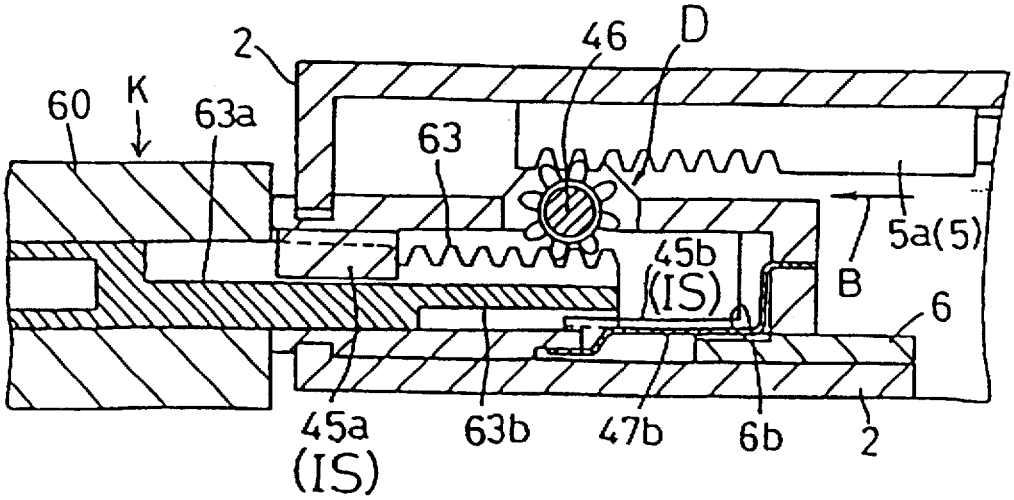
FIG. 19 is an enlarged view of principal portions relating to the embodiment of the present invention, FIG. 20(*a*), (*b*) are operation descriptive views of a booster circuit relating to an embodiment of the present invention.

At the portion of the jack unit 4 on the inner side of the box 2, there is provided the slider 5 having the rack portion 5*a* engaging the pinion gear 46 of the jack unit 4 under the condition shown in FIG. 19.

The slider 5 is slidably engageable with an unillustrated guide portion provided in the inner wall of the box 2. The slider is slidable in the direction denoted with an arrow A in FIG. 6, i.e. the inserting/withdrawing direction of the rack portion 63 of the engagement releasing key K, with the slider being urged to return toward the inner side of the box.

The slider 5, as shown in FIGS. 6 through 10, includes a first pressing portion 5*d* for contacting the end 41*b* of the lock spring 41 and a second pressing portion 5*e* for contacting the end 42*b* of the lock spring 42, in association with the sliding movement of the slider 5. The distance between the end 42*b* of the lock spring 42 and the second pressing portion 5*e* is set to be longer than the distance between the end 41*b* of the lock spring 41 and the first pressing portion 5*d*.

Figures 16A, 16B, 16C:
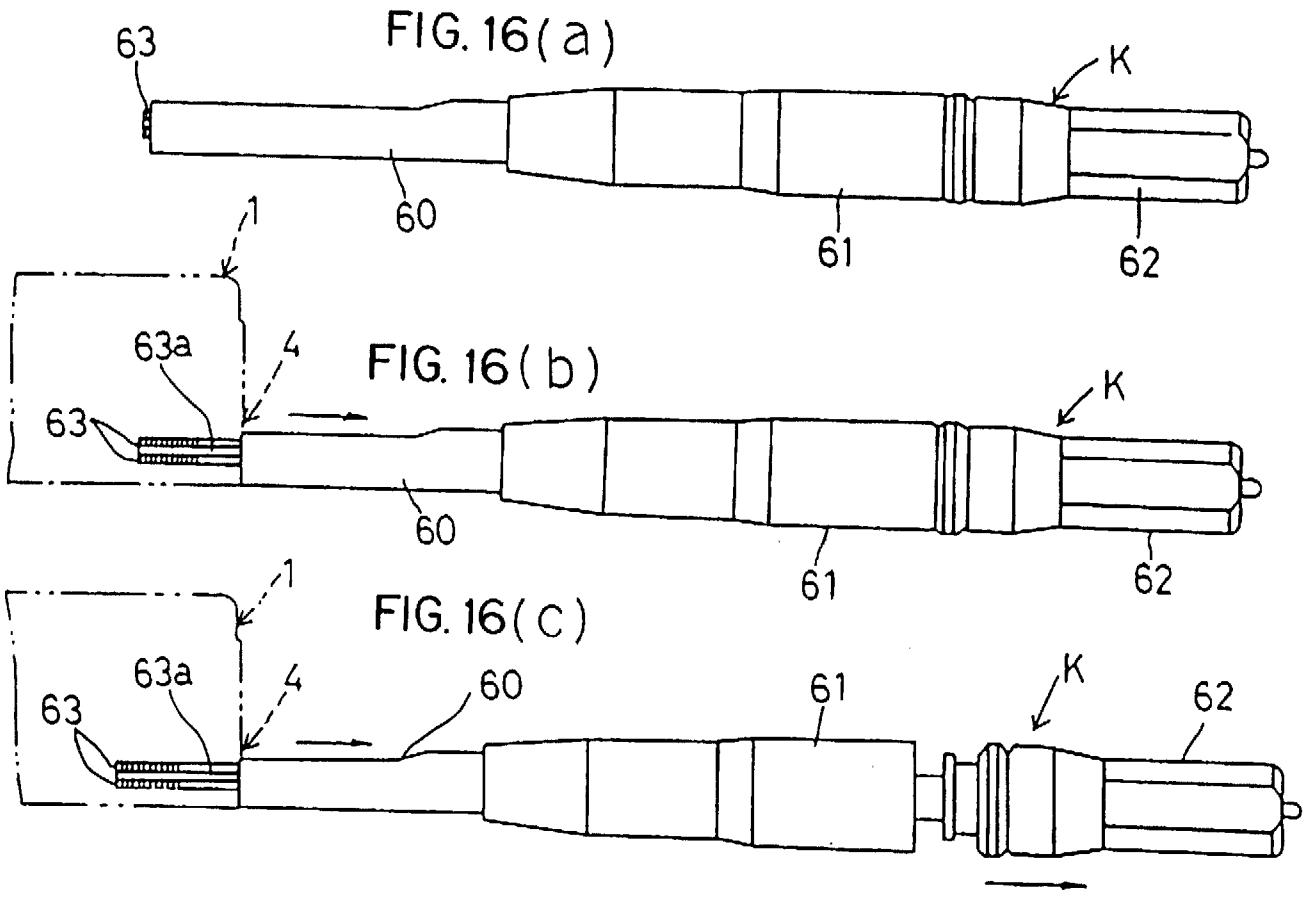

The engagement releasing key K has an outer shape as shown in FIG. 16(*a*). And, as shown in FIG. 16(*b*) and FIG. 16(*c*), as an inner sleeve 60 longitudinally movable relative to an outer sleeve 61 and urged to return in a departing direction is inserted into the outer sleeve 61, the rack portion 63 fixedly connected with the outer sleeve 61 appears. Incidentally, the leading end of the rack portion 63 is slightly exposed from the leading end of the inner sleeve 60 so as to facilitate the insertion of the rack portion 63 into the key insertion hole 45.

The insertable amount of the inner sleeve 60 into the outer sleeve 61 can be set to two steps, i.e. the condition shown in FIG. 16(*b*) in which an adjusting cap 62 is tightened relative to the outer sleeve 61 and the further condition shown in FIG. 16(*c*) in which the adjusting cap 62 is loosened relative to the outer sleeve 61. And, the insertable amount is set smaller in the case of the condition of FIG. 16(*b*) in which the adjusting cap 62 is tightened.

As the outer diameter of the leading end of the inner sleeve 60 is formed larger than the diameter of the entrance opening of the key insertion hole 45, when the rack portion 63 is inserted into the key insertion hole 45, the leading end of the inner sleeve 60 is brought into abutment against the jack unit 4 and the inner sleeve 60 is fitted into the outer sleeve 61. And, when the amount of this insertion has reached to the insertable amount set as described above, the rack portion 63 cannot be inserted any further, whereby the insertion amount of the rack portion 63 into the key insertion hole 45 is restricted.

Accordingly, the insertion amount of the rack portion 63 into the key insertion hole 45 can be adjusted in two steps by the above-described operation of the adjusting cap 62.

Figure 17A:
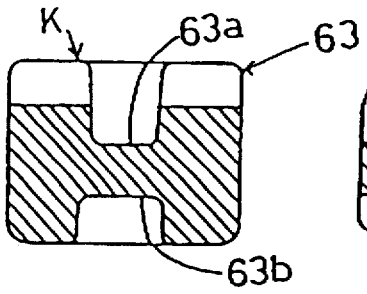
Figure 17B:
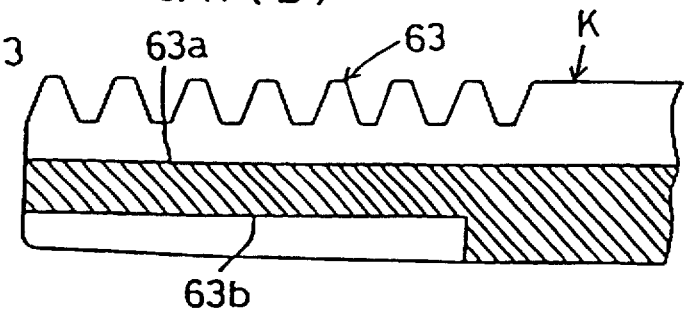

The rack portion 63, as shown in FIG. 17(*a*) showing it as viewed from the side of its leading end and also in FIG. 17(*b*) which is its partial section view, has a shape having two concave grooves of a long groove 63*a* on the side of forming the rack and a short groove 63*b* on the side away from the rack forming side.

The cross sectional shapes of the long groove 63*a* and the short groove 63*b* substantially correspond respectively to the cross sectional shapes of the blocking wall 45*a* formed at the entrance side of the key insertion hole 45 and the blocking wall 45*b* formed at the bottom side of the key insertion hole 45 as viewed from the key inserting direction in FIG. 15. As the entrance-side blocking wall 45*a* engages with the long groove 63*a* and the bottom-side blocking wall 45*b* engages with the short groove 63*b* respectively, the rack portion 63 of the engagement releasing key K may be inserted into the key insertion hole 45 without being blocked by the blocking walls 45*a* and 45*b*.

Accordingly, the two blocking walls 45*a*, 45*b* function as insertion preventing means IS for preventing insertion into the key insertion hole 45 of a fake operating tool having a shape other than a predetermined shape while allowing insertion into the key insertion hole 45 of the rack portion 63 having the predetermined shape.

Incidentally, as the long groove 63*a* of the rack portion 63 corresponds with the entrance-side blocking wall 45*a* of the key insertion hole 45, this groove is formed longer than the short groove 63*b* corresponding to the bottom-side blocking wall 45*b*.

Next, engagement and release of the engagement between the wire unit 3 and the box 2 will be described.

First, for engaging the wire unit 3 with the box 2, from the condition of FIG. 6 in which both of the lock pins 30 of the wire unit 3 are disengaged, one lock pin 30 is inserted into the lock pin insertion hole 40*b* of the jack unit 4 as illustrated in FIG. 7. When the lock pin 30 is inserted against the urging force of the coil spring 44*b* disposed at the lock pin insertion hole 40*b*, the engaging concave portion 30*a* of the lock pin 30 comes into engagement with the convex portion 42*a* of the lock spring 42 projecting inside the lock pin insertion hole 40*b*, whereby the urging force of the coil spring 44*b* reliably prevents the movement of the lock pin 30 in the releasing direction thereby to maintain the engaged condition.

Figure 8:
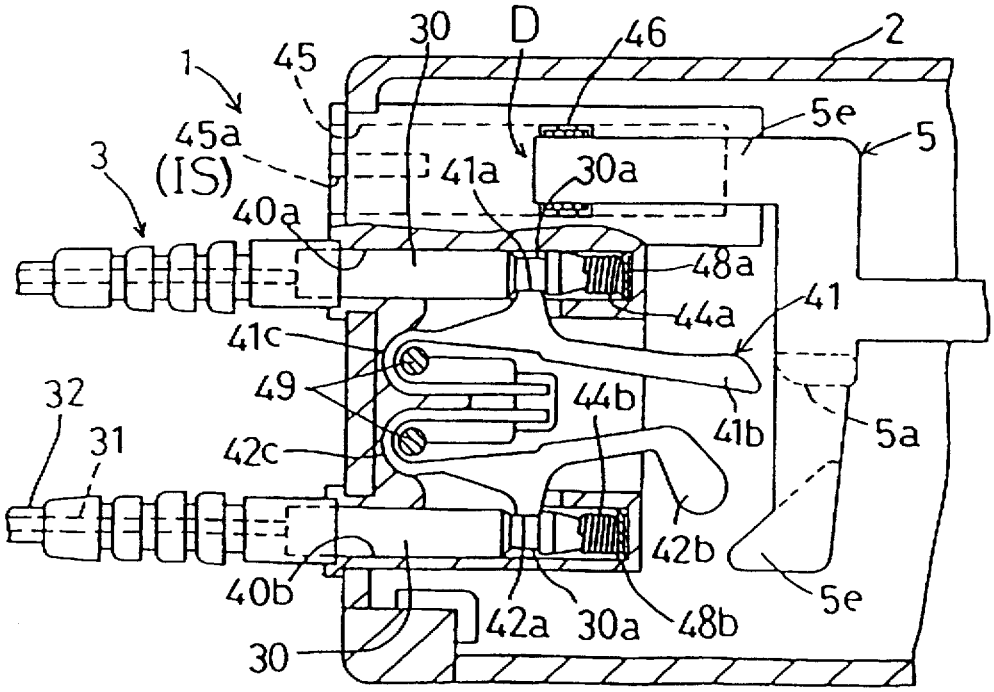
FIG. 8 is an enlarged view of principal portions relating to the embodiment of the present invention.

With the one lock pin 30 being inserted into the jack unit 4, after the other lock pin 30 is engaged with e.g. a commodity, then, as shown in FIG. 8, this lock pin is inserted into the lock pin insertion hole 40*a* of the jack unit 4. When the lock pin 30 is inserted against the urging force of the coil spring 44*a* provided in the lock pin insertion hole 40*a*, the engaging concave portion 30*a* of the lock pin 30 comes into engagement with the convex portion 41*a* of the lock spring 41 projecting into the lock pin insertion hole 40*a*, thus the urging force of the coil spring 44*a* reliably prevents movement of the lock pin 30 in the releasing direction, thereby to maintain the engaged condition.

When the two lock pins 30 of the wire unit 3 are inserted into the lock pin insertion holes 40*a*, 40*b* in the manners described above, the battery V starts power supply to the respective circuits shown in FIG. 5. And, under this condition, if the wire unit 3 is cut off for example, the sensor tag 1 outputs the alarm as described hereinbefore.

Next, from the condition shown in FIG. 8, for releasing the engagement between the wire unit 3 and the jack unit 4, the engagement releasing key K shown in FIG. 16 is used.

For detaching the sensor tag 1 from the object of theft prevention, the lock pin 30 is disengaged from only the lock pin insertion hole 40*a* adjacent the key insertion hole 45 so as to detach the tag from the object of theft prevention.

And, when it is necessary to replace the wire unit 3 for example, the other lock pin 30 inserted into the lock pin insertion hole 40*b* distant from the key insertion hole 45 too is disengaged.

For removing the lock pin 30 only from the lock pin insertion hole 40*a* adjacent the key insertion hole 45, the adjusting cap 62 is tightened to set the insertion amount of the rack portion 63 short. Then, under this condition, the engagement releasing key K is used. Further, for removing the lock pin 30 also from the lock pin insertion hole 40*b* distant from the key insertion hole 45, the adjusting cap 62 is loosened to set the insertion amount of the rack portion 63 into the key insertion hole 45 longer. Then, under this condition, the engagement releasing key K is used.

Figure 18:
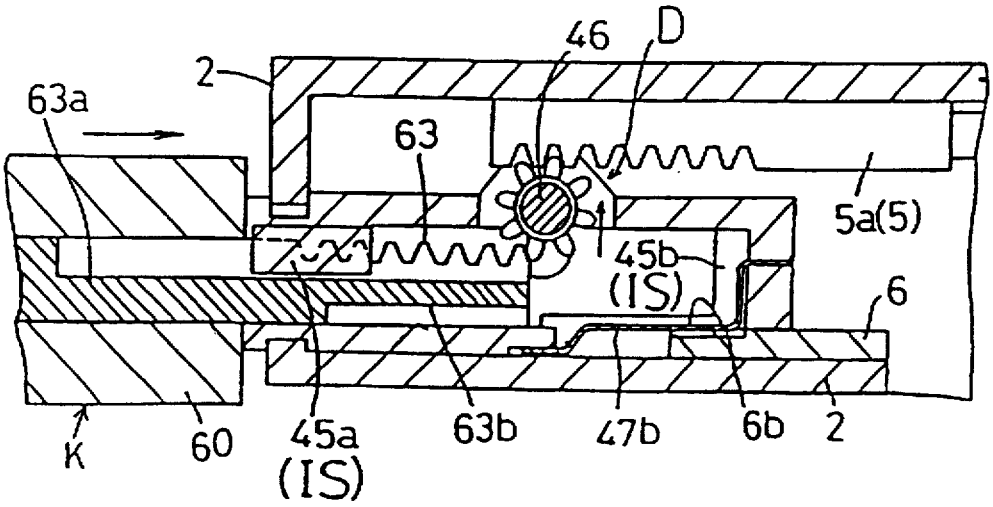
FIG. 18 is an enlarged view of principal portions relating to the embodiment of the present invention.

When the rack portion 63 of the engagement releasing key K is inserted into the key insertion hole 45, as illustrated in FIG. 18, the leading end of the rack portion 63 pushes up the pinion gear 46 into engagement with the rack portion 5*a* of the slider 5. When the rack portion 63 is further inserted, as illustrated in FIG. 19, the rack portion 63 of the engagement releasing key K comes into engagement with the pinion gear 46, so that the pinion gear 46 is rotated in association with the insertion of the rack portion 63. With this rotation of the pinion gear 46, the slider 5 having the rack portion 5*a* meshing with the pinion gear 46 is moved in the direction of an arrow B in FIGS. 9 and 19.

Referring to the amount of this movement of the slider 5, the insertion amount of the rack portion 63 when the adjusting cap 62 of the engagement releasing key K is tightened is set so that the first pressing portion 5*d* of the slider 5 contacts the end 41*b* of the lock spring 41 but the second pressing portion 5*e* and the end 42*b* of the lock spring 42 do not yet contact with each other.

Figure 9:
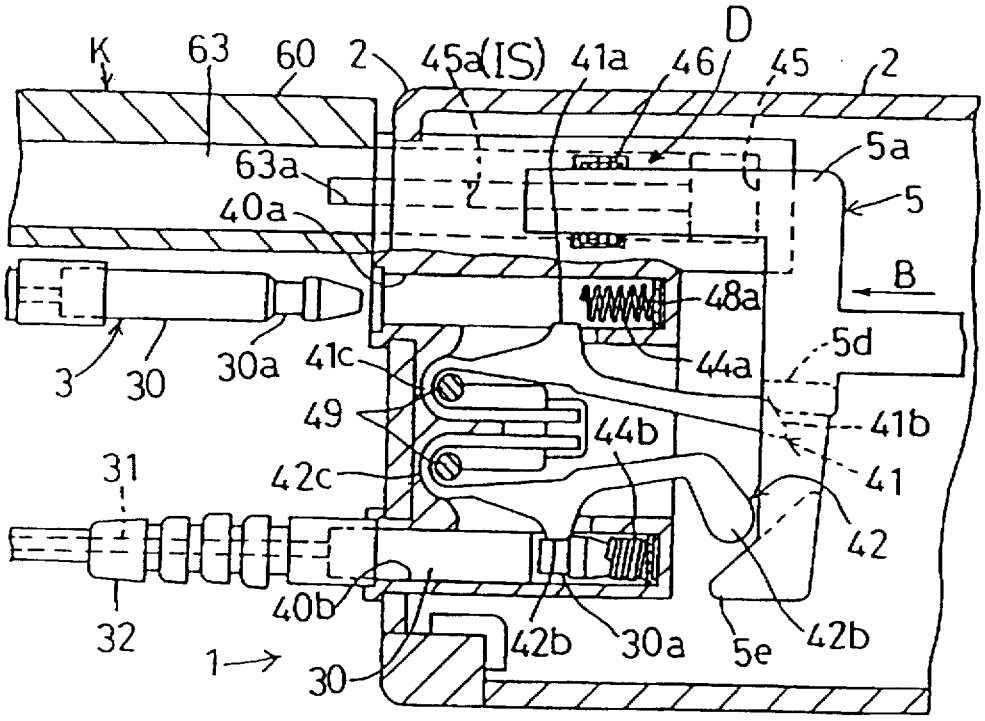
FIG. 9 is an enlarged view of principal portions relating to the embodiment of the present invention.

When the first pressing portion 5*d* pushes the end 41*b* of the lock spring 41 in association with the sliding movement of the slider 5, as shown in FIG. 9, the convex portion 41*a* of the lock spring 41 is pivoted away from the lock pin insertion hole 40*a*. In this manner, the engagement between the engaging concave portion 30*a* of the lock pin 30 and the convex portion 41*a* of the lock spring 41 is released.

As a result, the lock pin 30 inserted into the lock pin insertion hole 40*a* is pushed out by the urging force of the coil spring 44*a*, thus the lock pin 30 is disengaged from the lock pin insertion hole 40*a*.

When the rack portion 63 of the engagement releasing key K is inserted into the key insertion hole 45, as illustrated in FIG. 19, the rack portion 63 comes into contact with the pair of reset terminals 47*a*, 47*b*. As the rack portion 63 is made of conductive material, as the rack portion 63 as a conductive portion comes into contact with the pair of reset terminals 47*a*, 47*b*, the reset switch R of FIG. 5 is closed. As a result, with activation of the power supply retaining circuit VK, the power supply from the battery V to the respective circuits of FIG. 5 is stopped, and the alarm output means AO is rendered inoperative.

Accordingly, the pair of reset terminals 47*a*, 47*b* and the power supply retaining circuit VK shown in FIG. 5 together function as alarm releasing means AR to be operated into the alarm releasing state by the rack portion 63 of the engagement releasing key K as the bar-like releasing tool to be inserted into the key insertion hole 45.

From the condition in which the lock pin 30 has been withdrawn from the lock pin insertion hole 40*a*, for withdrawing also the lock pin 30 inserted into the lock pin insertion hole 40*b*, the rack portion 63 of the engagement releasing key K with the adjusting cap 62 being loosened in the afore-described manner is inserted into the key insertion hole 45.

As the adjusting cap 62 has been loosened, the rack portion 63 is inserted into the key insertion hole 45 by the long distance, so that the amount of sliding movement of the slider 5 in the direction of arrow B in FIG. 9 is greater than the case when the adjusting cap 62 is tightened. Consequently, the second pressing portion 5*e* of the slider 5 and the end 42*b* of the lock spring 42 now come into contact with each other, which do not contact with each other in the case of inserting the engagement releasing key K with the adjusting cap 62 being tightened.

Figure 10:
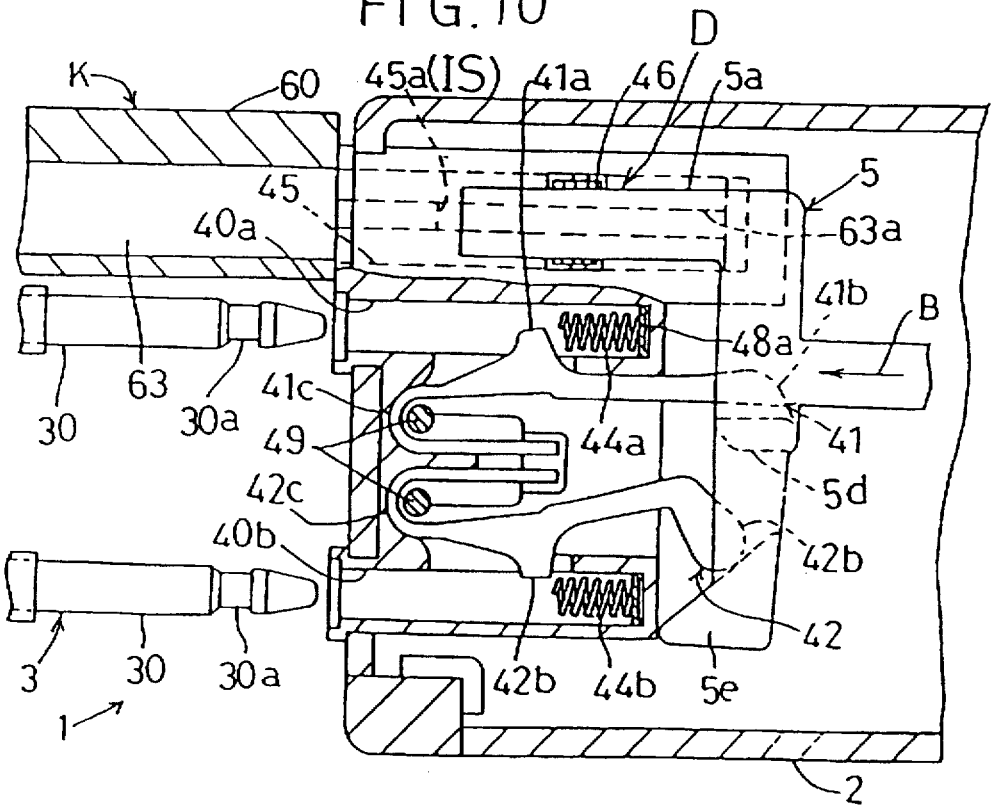
FIG. 10 is an enlarged view of principal portions relating to the embodiment of the present invention.

When the second pressing portion 5e pushes the end 42b of the lock spring 42, as shown in FIG. 10, the convex portion 42a of the lock spring 42 is pivoted away from the lock pin insertion hole 40b. In this manner, the engagement between the engaging concave portion 30a of the lock pin 30 and the convex portion 42a of the lock spring 42 is released.

As a result, the lock pin 30 inserted in the lock pin insertion hole 40b is pushed out by the urging force of the coil spring 44b, whereby the lock pin 30 is withdrawn from the lock pin insertion hole 40b.

Next, further embodiments will be described specifically.

Figure 22A:
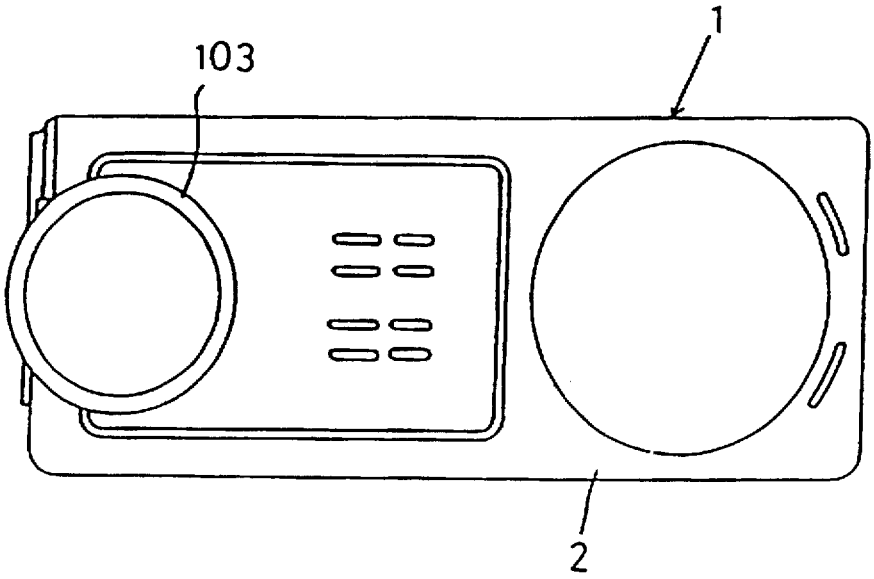
Figure 22B:
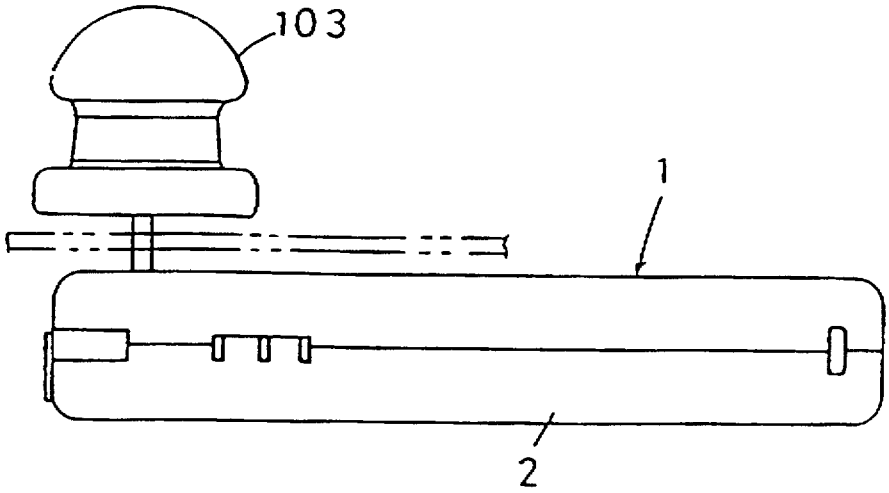

(1) In the foregoing embodiment, the present invention is applied to the construction in which the sensor tag 1 is attached to the object of theft prevention via the wire unit 3. Instead, as shown in FIG. 22(*a*) and FIG. 22(*b*), a further construction is possible in which a pin 103 is inserted into the box 2 via a cloth or the like as the object of theft prevention.

Figure 23:
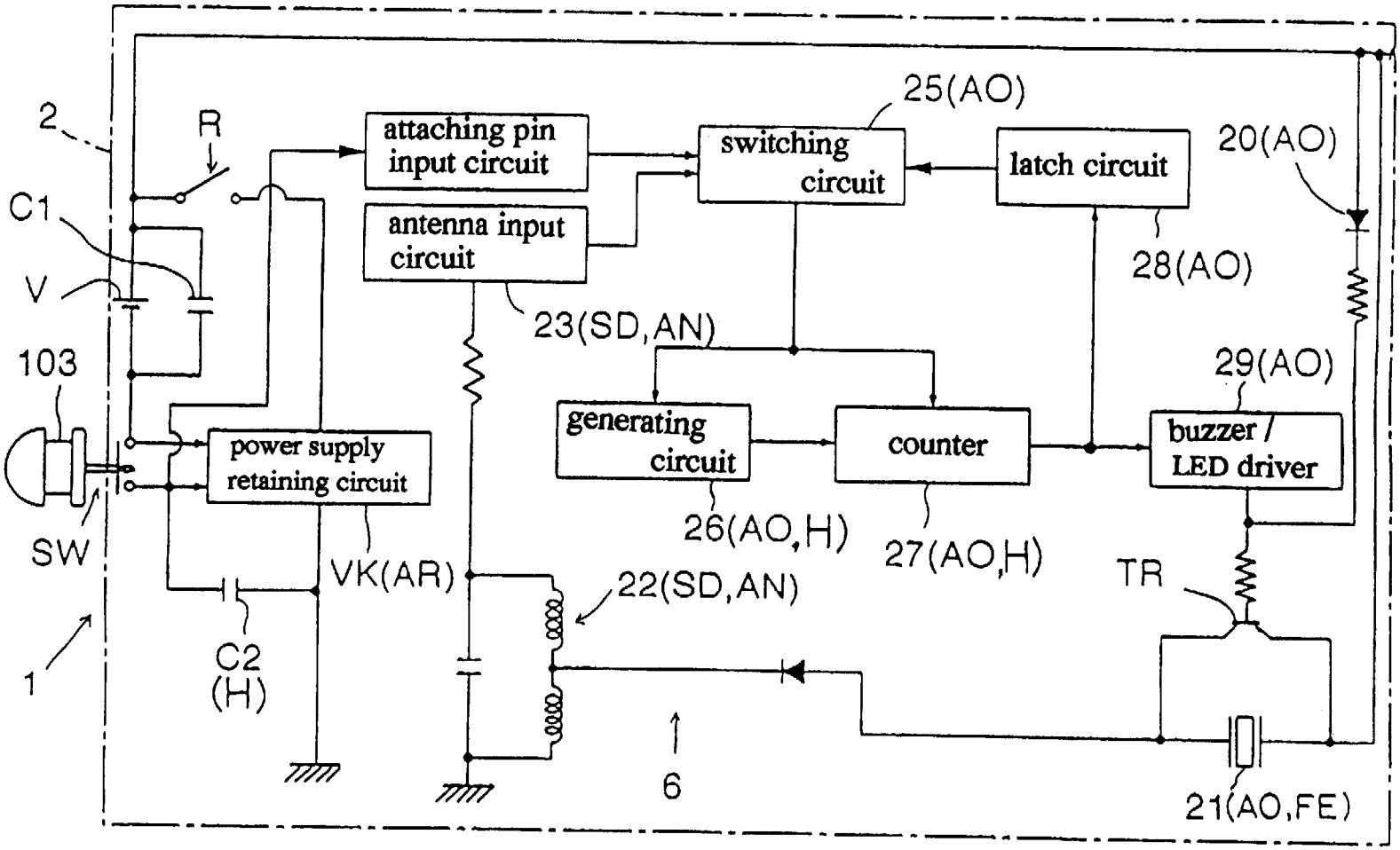
FIG. 23 is a circuit construction diagram relating to the further embodiment of the present invention, FIGS. 24 (*a*), (*b*), (*c*) and (*d*) are enlarged views showing principal portions relating to the further embodiment of the present invention.
Figure 24A:
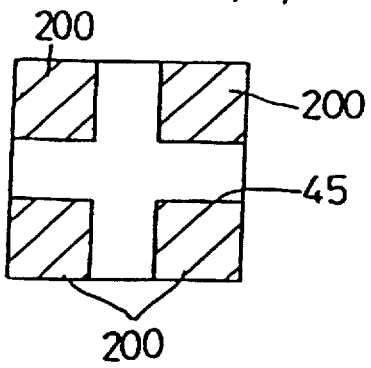
Figure 24B:
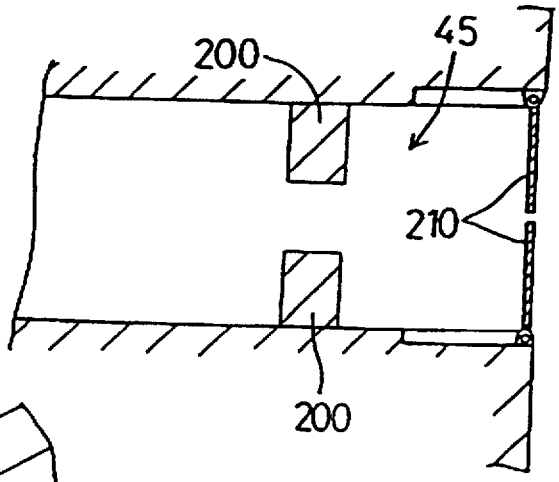
Figure 24C:
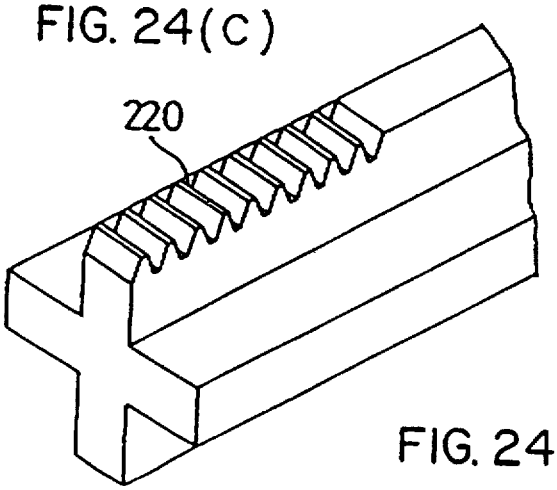
Figure 24D:
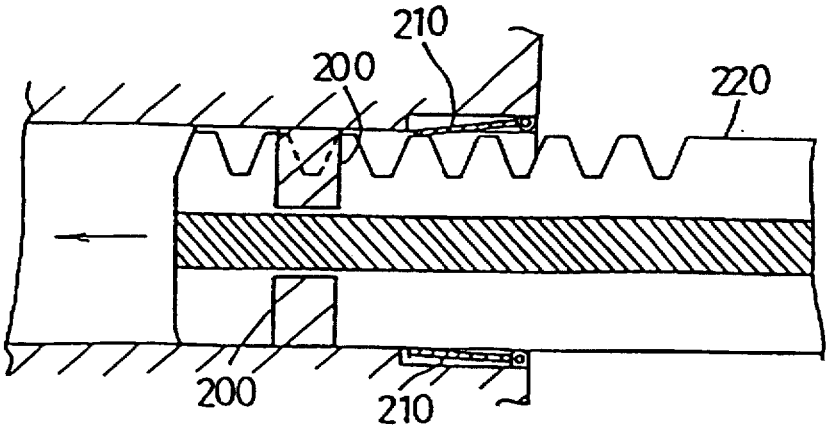

In such construction too, as shown in FIG. 23, the circuitry construction may be substantially same as that shown in FIG. 5. So that, in association with the insertion of the pin 103 into the box 2, the detecting switch SW is closed and with this closure of the detecting switch SW the power supply from the battery V to the respective circuits will be initiated.

(2) In the foregoing embodiment, as the battery V, a button battery was employed. But, the specific kind and shape of the battery V may vary in many ways. Also, the fitting construction for fitting the battery V in the box 2 and also the electrical connecting construction between the battery V and the circuit board 6 too may vary in many ways, depending on the kind and shape of the battery V.

(3) In the foregoing embodiment, the alarm output means AO outputs the alarm information by means of illumination of the LED lamp 20 and generation of alarm sound from the piezoelectric buzzer 21. A further construction is possible in which an alarm radio wave is transmitted as alarm information. And, this radio wave is received by a receiver installed at a certain site inside a shop, whereby an alarm sound is issued. As a further conceivable construction, the generation of the alarm sound may be displayed by displaying means to be monitored in a central monitor room.

(4) In the foregoing embodiment, the insertion preventing means IS is comprised of the two blocking walls 45a, 45b. Instead, this may be comprised of an insertion preventing wall 200 having a cross sectional shape shown in FIG. 24(*a*) as viewed along the longitudinal direction of the key insertion hole 45.

Though not shown in FIG. 24, the insertion preventing wall 200 is disposed between the entrance opening of the key insertion hole 45 and the pinion gear 46. And, as shown in FIG. 24(*b*), at the entrance opening of the key insertion hole 45, there are provided door members 210 which are pivotally opened and closed at the center thereof and also are urged to the closed side, so as to make it difficult to observe the shape of the insertion preventing wall 200 from the outside.

As the engagement releasing key K, as shown in FIG. 24(*c*), there is provided a bar-like engagement releasing tool having a cross-shaped cross section matched with the shape of the insertion preventing wall 200. Then, when the rack portion 220 is inserted into the key insertion hole 45, as shown in FIG. 24(*d*), the inserted rack portion presses and opens up the door members 210 and passes through the position of the insertion preventing wall 200 and then rotatably drives an unillustrated pinion gear 46.

(5) In the foregoing embodiment, the insertion preventing means IS is comprised of the two blocking walls 45a, 45b fixedly provided to the inner wall of the key insertion hole 45. Instead, the blocking walls may be provided to be retractable into the inner wall of the key insertion hole 45. Then, when the blocking walls are retracted with a fake operating tool coming contact into the blocking walls, this retraction is detected and binding elements binding the fake operating tool are caused to project into the key insertion hole 45, thereby to prevent insertion of the fake operating tool into the key insertion hole 45.

(6) In the foregoing embodiment, as the insertion preventing means IS, two blocking walls 45a, 45b are provided. Instead, only one or more than three of them may be provided.

(7) In the foregoing embodiment, as the specific construction of the auxiliary power supplying means, a power supplying capacitor C1 was employed. But, the specific construction of the auxiliary power supply means may vary in many ways. For instance, a rechargeable battery may be employed.

Figure 25:
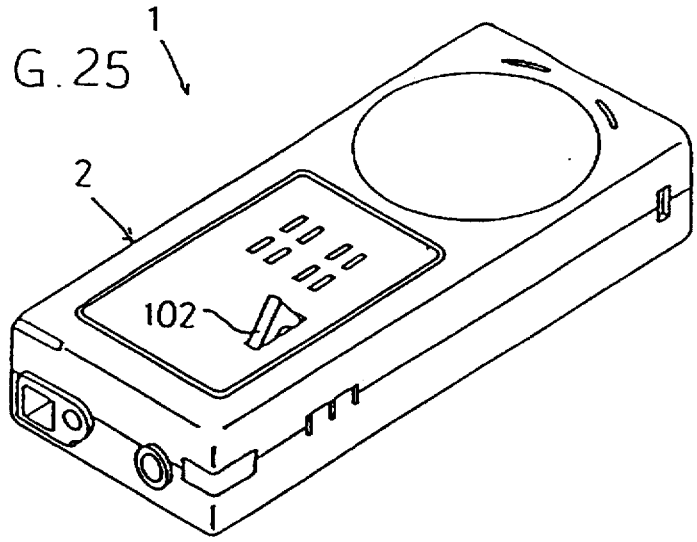
FIG. 25 is a perspective view of a sensor tag relating to a still further embodiment of the present invention.

(8) As shown in FIG. 25, the sensor tag I may includes an operating portion 102 for the attachment/detachment detecting switch (not shown) provided inside the box 2, with the portion 102 being urged to return to project from the surface of the box 2 and this sensor tag 1 will be placed in pressed contact with the surface of the object of theft prevention such as a book, with the tag and the object of theft prevention being wrapped together. In this case, if the sensor tag 1 is detached from the object of theft prevention, the operating portion 102 is caused to project to activate the attachment/detachment switch, whereby a detachment detection signal is outputted.

(9) In the foregoing embodiment, the preliminary act detecting means SD includes an attachment tool (the wire unit 3 or the like) and the attachment/detachment detecting switch SW and outputs, as the preliminary stealing act detection information, the detachment detection signal indicating detachment of the attachment tool from the box 2; and also the preliminary act detecting means SD includes the antenna 22 to output an antenna reception signal as the preliminary stealing act detection information. But, the preliminary act detecting means SD is not limited to these constructions.

(10) In the foregoing embodiment, the checking means H is comprised of the delaying capacitor C2, the generating circuit 26 and the counter 27. But, the checking means is not limited thereto. Instead of this, the checking means may be comprised of any other hard-ware circuit or may be comprised of e.g. a calculating unit such as a microcomputer for providing the function through a soft ware.

(11) In the foregoing embodiment, the radio wave receiving antenna incorporated in the preliminary act detecting means SD is comprised of the resonance antenna 22. The invention is not limited thereto, and various kinds of antenna may be employed.

(12) In the foregoing embodiment, there was described an application in which the theft preventive apparatus (sensor tag) is used in combination with a transmitter. Instead, without providing any transmitter, the object of theft prevention may be connected with a predetermined fixed position via the theft preventive apparatus, such that alarm information will be outputted if the connection to the fixed position by the theft preventive apparatus is released by e.g. withdrawal of the attachment tool or cutting off in an attempt to unlawfully take out the object of theft prevention.

(13) The construction of the conductive spring, constituting the present invention, which is contacted and pressed by an end of the connecting portion inserted into an insertion hole for attachment tool connection thereby to be retracted toward the longitudinally depth side in the insertion hole is not particularly limited. For instance, this may be a plate spring.

(14) In the foregoing embodiment, the booster circuit for boosting the voltage pulse to be applied to the piezoelectric buzzer 21 was constructed as shown in FIG. 5. Instead, this may be constructed also as shown in FIG. 26 or FIG. 27.

Figure 26:
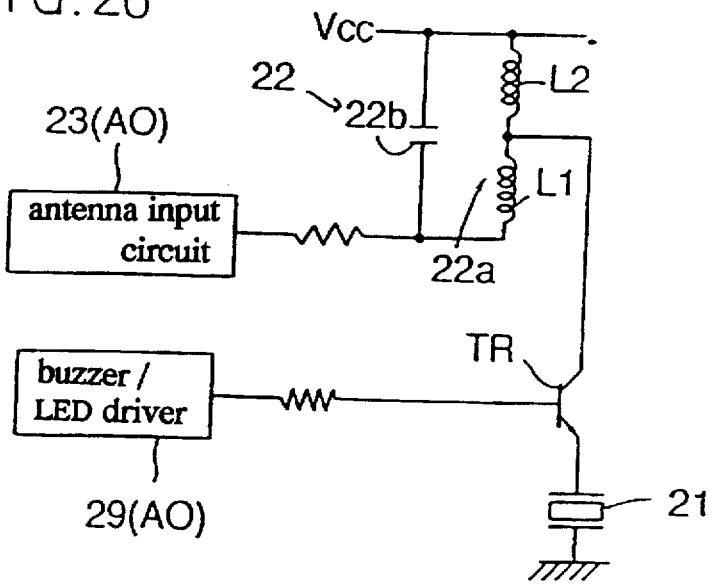
FIG. 26 is a diagram of a booster circuit relating to the further embodiment of the present invention.
Figure 27:
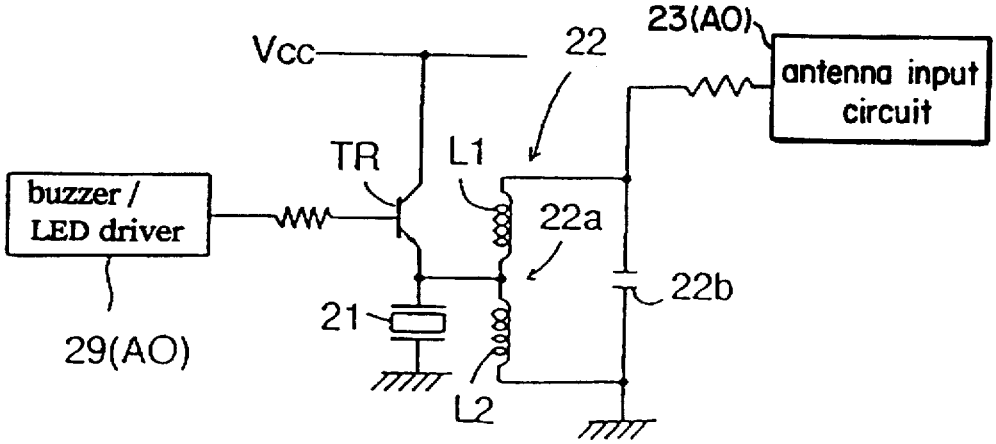
FIG. 27 is a diagram of a booster circuit relating to the further embodiment of the present invention.

In FIG. 26 and FIG. 27, only those portions relating to the booster circuit are shown.

In the case of a booster circuit shown in FIG. 26, a coil L2 constituting a part of the coil 22*a* of the resonance coil 22 and the piezoelectric buzzer 21 together form a serial resonance circuit, thereby to boost the voltage pulse to be applied to the piezoelectric buzzer 21.

In the case of the circuit shown in FIG. 26, the resonance antenna 22 is connected to the Vcc side, i.e. the positive terminal of the battery V, the antenna input circuit 23 detects the sound generation instruction radio wave from the transmitters O when the signal from the resonance antenna 22 becomes lower than the predetermined potential.

In the case of the circuit shown in FIG. 27, the coil L2 constituting a part of the coil 22*a* of the resonance antenna 22 and the piezoelectric buzzer 21 together constitute a parallel resonance circuit, thereby to boost the voltage pulse to be applied to the piezoelectric buzzer 21.

(15) In the foregoing embodiment and the further embodiment, the booster circuit is constructed with utilizing a portion of the coil 22*a* of the resonance antenna 22. Instead, the booster circuit may be constructed with utilizing the entire coil 22*a*.

(16) In the foregoing embodiment, as an example of an electrically capacitive buzzer, the piezoelectric buzzer 21 was described. Instead, various kinds of electrostatic type speaker may be employed as a buzzer.

(17) In the foregoing embodiment, the alarm releasing means AR is rendered into the alarm releasing state when the pair of reset terminals 47*a*, 47*b* are short-circuited. Instead, the alarm releasing means may be constructed such that the reset switch R is turned ON/OFF in mechanical association with insertion of the engagement releasing key K into the key insertion hole 45.

(18) In the foregoing embodiment, the coil 22*a* of the resonance antenna 22 is wound about the thickness-wise axis of the box 2 having a flat rectangular shape. In addition to this resonance antenna 22, a further resonance antenna having a coil wound about an axis extending normal to the thickness direction may be provided also, so as to be effectively detect a sound generation instructing radio wave from various directions.

What is claimed is:

1. A theft preventive apparatus including a box (2) to be attached to an object of theft prevention, preliminary act detecting means (SD) provided in the box for detecting a preliminary theft act, alarm output means (AO) disposed inside the box (2) for outputting alarm information based on detection information of the preliminary act detecting means (SD), a first wall portion (2*a*) of a pair of opposed wall portions (2*a*), (2*c*) of the box (2) supporting a circuit board (6) of the alarm output means (AO), a second wall portion of the pair of opposed wall portions of the box (2*c*) supporting a first-kind constituting element (FE) of the alarm output means (AO), a power-supply contact member (CE) integrally formed with the first-kind constituting element (FE) is constructed so as to contact a first-kind contact (FC) having a contact face extending toward the second wall side of the circuit board (6);

wherein the power-supply contact member (CE) is comprised of a coil spring which can expand and contract in the approaching/departing direction of the pair of wall portions (2*a*), (2*c*) and which is disposed with being compressed from a maximally expanded state thereof;

a radio-wave receiving antenna (22) having a coil (22*a*) is provided;

the alarm output means (AO) is rendered operative when the receiving antenna (22) receives a sound generation instructing radio wave;

inside the box (2), there is provided a radio-wave receiving signaling device forming a resonance circuit by connecting the alarm output means (AO) with the entire or part of the coil (22*a*) of the receiving antenna (22); and a transmitter (O) for transmitting the sound generation instructing radio wave to the receiving antenna (22) is installed at a predetermined site.

2. A theft preventive apparatus according to claim 1, wherein between the pair of wall portions (2*a*), (2*c*), a second-kind constituting element (SE) of the alarm output means (AO) is retained as being bound therebetween;

a power-supply relay member (71*a*) having one end contacting with a second-kind contact (SC) having a contact face extending toward the second wall portion side of the circuit board (6) and the other end contacting with the second-kind constituting element (SE) is disposed with an intermediate portion thereof retained to the first wall portion (2*a*); and a pressing coil spring (78) which is retained to the second wall portion (2*c*) to be expandable and contractable in the approaching/departing direction of the pair of wall portions (2*a*), (2*c*) and which presses one end of the power-supply relay member (71*a*) against the second-kind contact (SC) is disposed with being compressed from a maximally expanded state thereof.

3. A theft preventive apparatus according to claim 1, wherein the box (2) includes a first casing member (2A) having a cylindrical wall portion (2*b*) projecting from the first wall portion (2*a*) and projecting also from the periphery of the first wall portion toward the second wall portion and a second casing member (2B) having a cylindrical wall portion (2*d*) projecting from the second wall portion (2*c*) and projecting also from the periphery of the second wall portion toward the first wall portion; and end faces of the first and second casing members (2A), (2B) fused to each other.

4. A theft preventive apparatus according to claim 2, wherein the first-kind constituting element (FE) is a disc-shaped alarm buzzer (21); the second-kind constituting element (SE) is a disc-shaped battery (V); and this disc-shaped battery (V) is retained with being bound between the alarm buzzer (21) and the first wall portion (2*a*).

5. A theft preventive apparatus according to claim 1, wherein the preliminary act detecting means (SD) includes an attachment tool (3) to be connected with the box (2) for attaching the box (2) to the object of theft prevention and an attachment/detachment detecting switch (24) for electrically detecting attachment and detachment of this attachment tool (3) to and from the box (2); and the alarm output means (AO) outputs the alarm information based on the detachment detection signal from the attachment/detachment detecting switch (24).

6. A theft preventive apparatus according to claim 1, wherein the preliminary act detecting means (SD) includes an antenna (AN) disposed inside the box (2) for receiving a radio wave transmitted from the transmitter (O) installed at a predetermined site; and the alarm output means (AO) outputs the alarm information based on a reception signal from the antenna (AN).

7. A theft preventive apparatus according to claim 1, wherein a releasing tool (K) is formed in a predetermined shape; and inside an insertion hole (45) of the box, there is provided insertion preventing means (IS) for preventing insertion into the insertion hole (45) of a fake operating tool having a shape other than the predetermined shape while allowing insertion into the insertion hole (45) of the releasing tool (K) having this predetermined shape.

8. A theft preventive apparatus according to claim 7, wherein the insertion preventing means (IS) is comprised of a projection (45*a*), (45*b*) which projects from an inner wall portion of the insertion hole (45) into the inner space thereof as viewed in a longitudinal direction of the insertion hole (45); and the releasing tool (K) defines, in an outer face portion thereof, a concave groove (63*a*), (63*b*) into which the projection (45*a*), (45*b*) fits when the tool (K) is inserted into the insertion hole (45).

9. A theft preventive apparatus according to claim 8, wherein the projection (45*b*) is formed at a further inside portion than the entrance opening of the insertion hole (45).

10. A theft preventive apparatus according to claim 8, wherein the projection comprises a plurality of projections (45*a*), (45*b*) formed at different phases as viewed in the longitudinal direction of the insertion hole (45).

11. A theft preventive apparatus according to claim 10, wherein the plurality of projections (45*a*), (45*b*) are formed at different longitudinal positions of the insertion hole (45).

12. A theft preventive apparatus according to claim 8, wherein the projection (45*a*), (45*b*) is provided in the form of a projecting ridge extending along the longitudinal direction of the insertion hole (45).

13. A theft preventive apparatus according to claim 1, wherein, inside the box (2), there are provided a battery (V) for driving the preliminary act detecting means (SD) and the alarm output means (AO); and auxiliary power supplying means (Va) charged by the battery (V) and driving the preliminary act detecting means (SD) and the alarm output means (AO) when power supply from the battery (V) is cut off.

14. A theft preventive apparatus according to claim 13, wherein the alarm output means (AO) continuously outputs the alarm information even if the preliminary act detecting means (SD) makes no detection of preliminary stealing act, after the alarm output means (AO) has outputted the alarm information based on preliminary stealing act detection information of the preliminary act detecting means (SD).

15. A theft preventive apparatus according to claim 13, wherein the preliminary act detecting means (SD) includes an attachment tool (3) to be connected with the box (2) for attaching the box (2) to the object of theft prevention, and an attachment/detachment detecting switch (24) for electrically detecting attachment and detachment of the attachment tool (3) to and from the box (2); and the alarm output means (AO) outputs the alarm information based on a detachment detection signal from the attachment/detachment detecting switch (24) as the preliminary act detection information.

16. A theft preventive apparatus according to claim 13, wherein the preliminary act detecting means (SD) includes an antenna (AN) disposed inside the box (2) for receiving radio wave from the transmitter (O) installed at a predetermined site; and the alarm output means (AO) outputs the alarm information based on a reception signal of the antenna (AN) as the preliminary stealing act detection information.

17. A theft preventive apparatus according to claim 1, further comprising checking means (H) for allowing the alarm output means (AO) to output the alarm information only when the preliminary stealing act detection information outputted from the preliminary act detecting means (SD) continues to exist beyond a predetermined time period.

18. A theft preventive apparatus according to claim 17, wherein the preliminary act detecting means (SD) includes an attachment tool (3, 103) to be connected to the box (2) for attaching the box (2) to the object of theft prevention and an attachment/detachment detecting switch (SW) for electrically detecting attachment and detachment of the attachment tool (3, 103) to and from the box (2); and the alarm output means (AO) outputs the alarm information based on a detachment detection signal from the attachment/detachment detecting switch (SW) as the preliminary stealing act detection information.

19. A theft preventive apparatus according to claim 17, wherein the preliminary act detecting means (SD) includes an antenna (22) disposed inside the box (2) for receiving radio wave from the transmitter (O) installed at a predetermined site; and the alarm output means (AO) outputs the alarm information as preliminary stealing act detection information, based on a reception signal of the antenna (22).

20. A theft preventive apparatus according to claim 1, wherein the apparatus further comprises an attachment tool (3) having, at opposed ends thereof conductive connecting portions (30) to be connected by being inserted into an insertion hole (40*a*, 40*b*) of the box (2) for connection with the attachment tool and having also a conductive intermediate connecting portion (31) for electrically interconnecting the connecting portions (30) at the opposed ends;

engaged portions (30*a*) are provided at the opposed connecting portions (30);

inside the box (2), there are provided engaging members (41, 42) which can engage with the engaged portions (30*a*) at the connecting portions (30) inserted into the insertion hole (40*a*, 40*b*) for connection with the attachment tool and which are urged toward the engaging side;

the alarm output means (AO) disposed inside the box (2) electrically connected with the opposed connecting portions (30) when the opposed connecting portions (30) are connected with the box (2) and outputting the alarm information based on a conductive path formed by the electrical connection becoming non-conductive; and withdrawal of the connecting portions (30) inserted into the insertion hole (40*a*, 40*b*) is prevented by means of engagement between the engaged portions (30*a*) and the engaging members (41, 42).

21. A theft preventive apparatus according to claim 20, wherein inside the box (2), there is provided a conductive spring (44*a*, 44*b*) which is contacted with and pressed against an end of the connecting portions (30) inserted into the insertion hole (40*a*, 40*b*) for connection of the attachment tool, with the spring being connected by means of a receiving member (48*a*, 48*b*) electrically connected with the alarm output means (AO).

22. A theft preventive apparatus according to claim 21, wherein the spring (44*a*, 44*b*) comprises a coil spring.

23. A theft preventive apparatus according to claim 21 wherein, inside the box (2), there are provided alarm releasing means (AR) for stopping operation of the alarm output means (AO) and engagement releasing means (D)for operating the engaging member (41, 42) into an engagement-released state;

an insertion hole (45) for releasing operation is defined to extend from the outer face of the box (2) toward the inside of the box;

the alarm releasing means (AR) is operated into the alarm releasing state and the engagement releasing means (D) is operated into an engagement releasing state by means of a releasing tool (K) to be inserted into the insertion hole (45) for releasing operation.

24. A theft preventive apparatus according to claim 21, wherein the spring (44*a*, 44*b*) is provided with an urging force which moves the connecting portion (30) to the outside of the box in association with an operation of the engaging member (41, 42) toward the engagement releasing side.

25. A theft preventive apparatus according to claim 21, wherein inside the box (2), there is provided an antenna (22) for receiving radio wave from the transmitter (O) installed at a predetermined site; and the alarm output means (AO) outputs the alarm information, based on a reception signal of the antenna (22).

26. A theft preventive apparatus according to claim 1, wherein there is provided a buzzer (21) having electric capacity; the alarm output means (AO) causes the buzzer (21) to generate a sound when the receiving antenna (22) receives the sound generation instructing radio wave; and the radio-wave receiving signaling device disposed in the box (2) forms a resonance circuit by connecting the buzzer (21) with the entire or part of the coil (22*a*) of the receiving antenna (22).

27. A theft preventive apparatus according to claim 26, wherein the alarm output means (AO) is constructed so as to cause the buzzer (21) to generate a sound in association with detection of preliminary act by the preliminary act detecting means (SD).

28. A theft preventive apparatus according to claim 26, wherein in the box (2), there is disposed alarm releasing means (AR) for stopping operation of the alarm output means (AO), and this alarm releasing means (AR) comprises sound generation releasing means;

an insertion hole (45) for releasing operation is formed to extend from the outer face to the inside of the box (2); and said sound generation releasing means (AR) is operated into a sound generating releasing state by means of a releasing tool (63) inserted into the insertion hole (45) for releasing operation.

* * * * *